US005913708A

United States Patent [19]

Gross

[11] Patent Number: 5,913,708

[45] Date of Patent: Jun. 22, 1999

[54] TOY, DOLL OR MANNEQUIN WITH DIMENSIONALLY VARIABLE EXTERIOR SURFACE

[76] Inventor: Flora Geane Gross, 175 E. Delaware Pl., Chicago, Ill. 60611

[21] Appl. No.: 08/855,381

[22] Filed: May 13, 1997

Related U.S. Application Data

[63] Continuation of application No. 08/451,992, May 26, 1995, abandoned.

[51] Int. Cl.[6] ..... A63H 3/36; A63H 3/06; A63H 33/00

[52] U.S. Cl. ..... 446/385; 446/183; 446/486

[58] Field of Search ..... 446/26, 27, 176, 446/180, 183, 184, 185, 197, 198, 199, 268, 295, 296, 321, 330, 337, 339, 340, 359, 373, 380, 381, 385, 391, 486

[56] References Cited

U.S. PATENT DOCUMENTS

| | | | |
|---|---|---|---|
| 1,604,087 | 10/1926 | Tate . | |
| 2,024,124 | 12/1935 | Barker | 446/385 |
| 2,154,121 | 4/1939 | Bold . | |
| 2,203,562 | 6/1940 | Edwards . | |
| 2,606,398 | 8/1952 | Miller | 446/385 |
| 3,153,881 | 10/1964 | Baulard-Cogan . | |
| 3,382,504 | 5/1968 | Barbosa . | |
| 3,541,192 | 11/1970 | Shapero et al. | 446/385 X |
| 3,731,426 | 5/1973 | Lewis et al. . | |
| 3,812,613 | 5/1974 | Glass et al. . | |
| 3,992,807 | 11/1976 | Sapkus et al. . | |
| 3,995,394 | 12/1976 | Ayton . | |
| 4,075,782 | 2/1978 | Neuschatz . | |
| 4,242,830 | 1/1981 | Hauser . | |
| 4,259,805 | 4/1981 | Hornsby, Jr. . | |
| 4,310,927 | 1/1982 | DeBose . | |
| 4,397,701 | 8/1983 | Johnson et al. | 446/385 X |
| 4,486,975 | 12/1984 | Harreld et al. . | |
| 4,828,528 | 5/1989 | Chatkis . | |
| 4,920,580 | 5/1990 | Liff | 446/27 X |
| 4,995,844 | 2/1991 | McNett et al. . | |
| 5,033,985 | 7/1991 | Nahas . | |
| 5,067,924 | 11/1991 | Munter . | |
| 5,079,778 | 1/1992 | Sloot . | |

FOREIGN PATENT DOCUMENTS

| | | | |
|---|---|---|---|
| 448936 | 9/1927 | Germany . | |
| 3404653 | 9/1985 | Germany | 446/385 |
| 0243211 | 2/1987 | Germany | 446/385 |
| 461689 | 5/1935 | United Kingdom . | |

*Primary Examiner*—D. Neal Muir
*Attorney, Agent, or Firm*—James T. FitzGibbon

[57] ABSTRACT

A method making a toy, doll, or mannequin wherein a relatively rigid core is covered with an elastic skin. The skin is bonded to the core in some areas but not others. This creates an expansible, variable volume pressurizable space between the core and the skin so that the skin may expand relative to the core to simulate weight gain or change of muscle tone. The method comprises selecting and/or treating the core so that only certain parts adhere to the skin-forming material, covering the core with a curable, skin-forming coating and allowing the material to form the skin that, after inflation, assumes a different size and/or shape than the core and thus simulates weight gain, change of muscle tone or other significant change of shape and appearance.

20 Claims, 16 Drawing Sheets

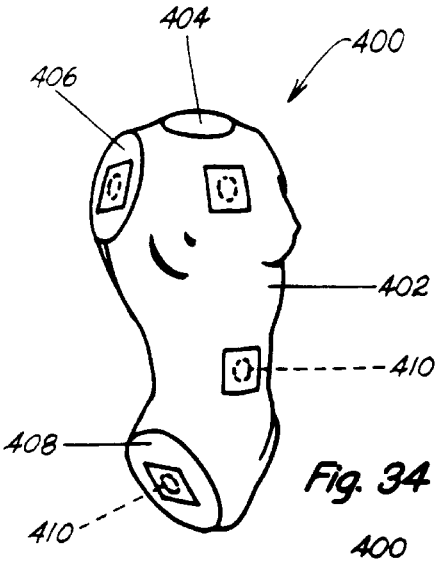
Fig. 34
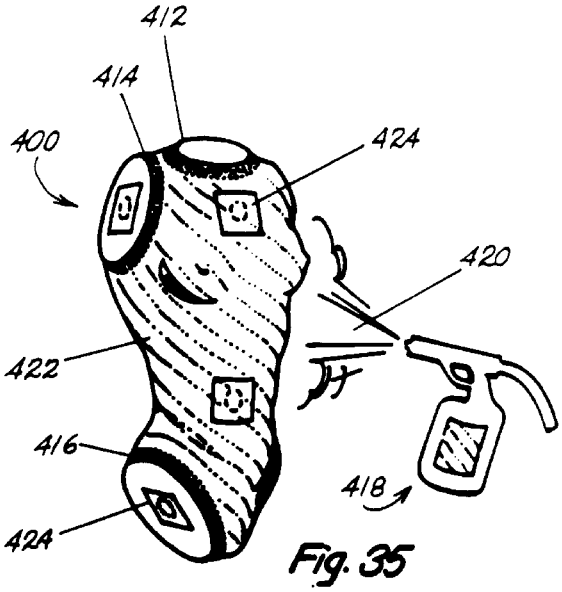
Fig. 35
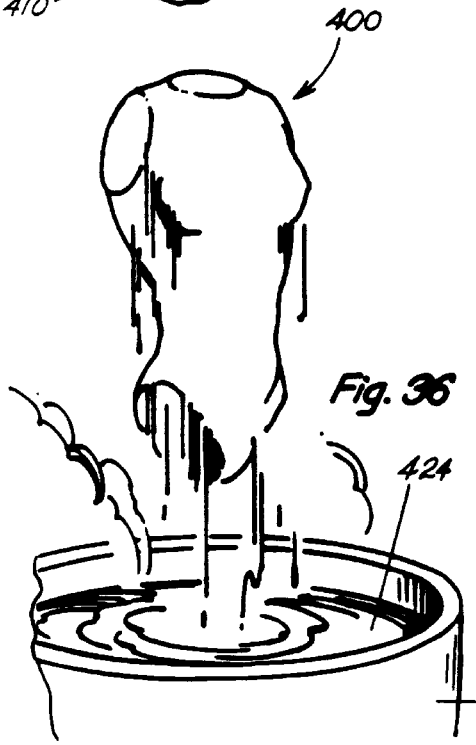
Fig. 36
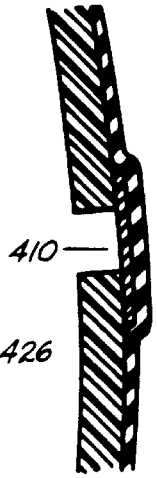
36A
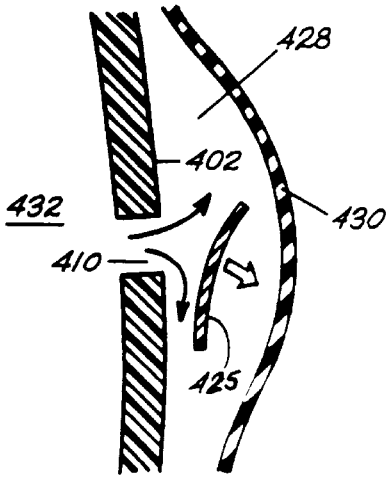
36B

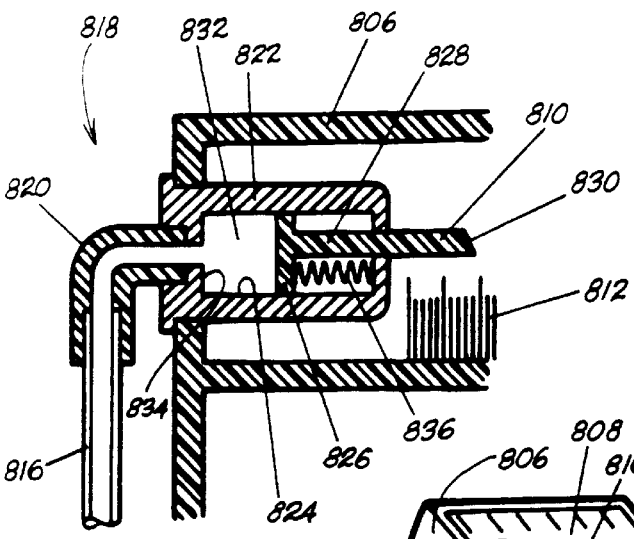
Fig. 50
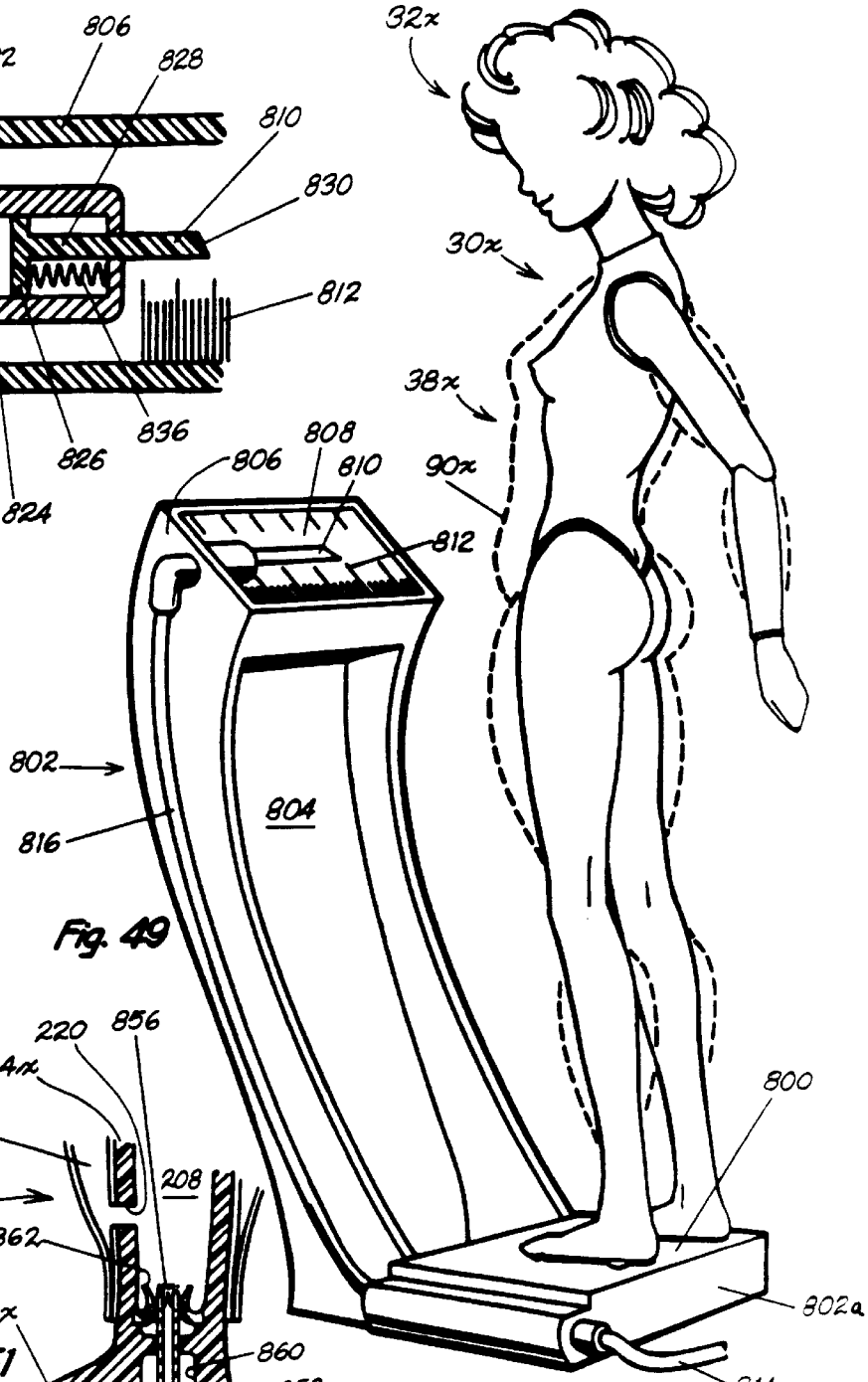
Fig. 49
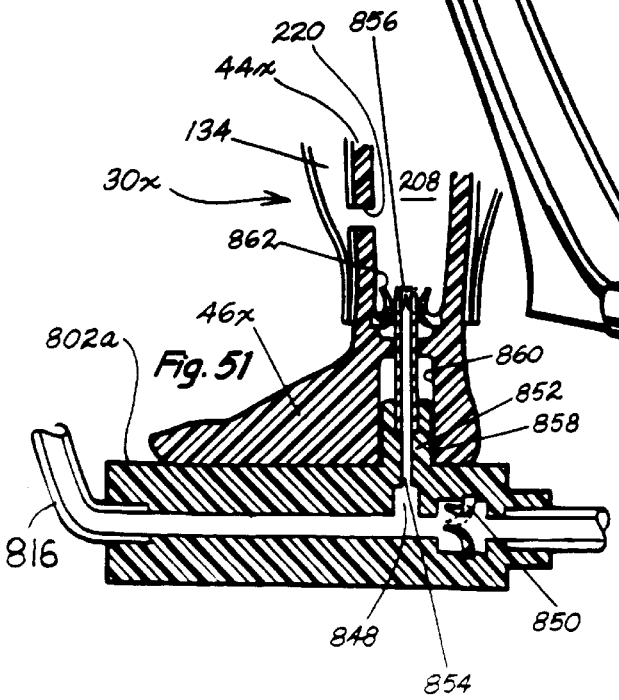
Fig. 51
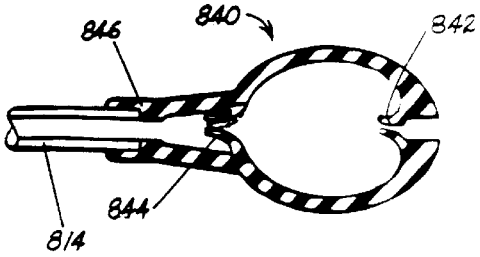

TOY, DOLL OR MANNEQUIN WITH DIMENSIONALLY VARIABLE EXTERIOR SURFACE

This application is a continuation of application Ser. No. 08/451,992, filed May 26, 1995 now abandoned.

The present invention relates generally to toy dolls or the like, and in particular, to a doll or toy figure capable of undergoing change or variation in its exterior body contour, without gain or loss of height. In one preferred form, the inventive product is a doll which, by reason of its construction, is able to expand and contract within set limits as though undergoing weight gain and loss, "musclebuilding" or like changes of exterior bodily contour.

In one form, the doll includes a structure in the form of an interior body having a compression resistant outer surface of a given size and overall contour, an exterior skin covering the interior body, and means for defining an expansible, variable volume space between the compression resistant outer surface of the interior body and the exterior skin portion. The exterior skin is thus able to be expanded from a position closely overlying the outer surface of the inner body to a surface representing an overall increase in bodily volume of 10% to 40% or more, for example. These changes are used to simulate or create the appearance of weight gain or loss, musclebuilding, pregnancy, or other illusion; this appearance change can be heightened by relating the change of body contours to a change in clothing sizes.

While the invention is capable of being embodied in a great number of forms, certain of the simplest-forms involve using a special bladder-like element to define some or all of an expansible, variable volume space between the exterior skin and the interior body. In other instances, the outer skin is constructed and arranged so that a separately formed bladder is not needed. In some of such instances, only the variable volume space between the skin and the outer surfaces of the interior body is inflated, whereas in other instances, a part of the interior body may also be exposed to or confine the fluid, usually air, in the expansible space.

The principles of the invention, i.e., an inner body of an initial volume and contour, an exterior "skin", and an expansible space therebetween, may be implemented not only as to the torso portion of a body, or even any selected portion of the torso, but also may be applied to the body as a whole, or only to some or all of the leg or arm portions of the doll. In still further embodiments, the principle of skin expansion and contraction may be achieved in regard to portions of the head, most typically creating an expansion or contraction of facial skin. The simulated effect may be more or less generalized weight gain or loss, muscle building, or another condition, such as pregnancy, for example.

While the inventive product may be used in different ways for different purposes, one typical embodiment or arrangement of the inventive principle calls for controlling the comparative degree of skin expansion by controlling the resilience of the "skin", either as a whole or in selected "skin" areas. This may be accomplished by making the skin at least in part from an elastic material such as a woven fabric, a reinforced latex material or other suitable composite material.

A major concern of adults and children alike today is that of generalized weight gain or loss. Literally tens oil millions of adults are very concerned with weight gain or loss from the standpoint of physical health and well being. It goes without saying that there is virtually a national preoccupation with achieving the desirable appearance resulting from a proper weight-to-height relation. Those interested in achieving a proper balance of weight in relation to height are motivated by the generally accepted principle that excess weight can be harmful to one's health. It is almost impossible to estimate the volume of material written on the subject or to summarize the innumerable, seemingly endless efforts made by those concerned with excess weight gain to minimize or forestall the unhealthy possibilities of large, generalized weight gain.

In addition to those who are concerned with undue weight gain from the standpoint of adverse effects on short and long term health, there are perhaps equal or greater numbers of persons concerned with weight gain or loss primarily or even only from the cosmetic standpoint. In this connection, many of those in the fashion industry seem to be in continual pursuit of providing clothing styles which appear best on slender users.

There is a whole area of fashion effort devoted to exercise clothing, most or all of which, including leotards, other "workout" clothes, swimming suits, jogging or exercise outfits and the like are of an elastic, skin-tight construction which is flattering to a lean figure, but which is unflattering to those who may be considered "overweight" by current fashion standards.

A preoccupation with appearance and health has, in turn, engendered continual, on-going mass interest in the subject of dieting, and one has only to refer daily to the popular press and to other more sensational sources to realize that "binge" eating and dieting are a common but undesirable fact of life.

With the above-referenced adult concern or preoccupation with causing the human figure, particularly female figures, to conform to a shape that is cosmetically desirable, there is a counterpart awareness of a desirable weight-to-height ratio awareness on the part of children. In part, this results simply from the tendency of children to mimic adults and share common interest with them. However, in other areas, there has been a positive awareness by children that avoiding excess weight is desirable in the interest of good health, and that better health may be achieved simply by good nutrition and eating habits, as opposed to attempting to remedy improper eating by periodic "crash" dieting. At any rate, the adventures of adults in attempting to achieve and maintain an "ideal" weight is not lost on children, particularly those whose parents have the foregoing awareness or concerns.

It is also well known to those in the toy and doll industry that there is a great deal of interest by children in dolls or like toys which are realistic, i.e., dolls or toys that simulate the circumstances and conditions facing adults in their daily lives, and/or which may be made to mimic the behavior of real adults and real children. Thus, there is a seemingly infinite variety of dolls that will simulate or replicate real human functions. These include the long known doll babies whose eyes close when they are placed in a recumbent position, those that cry or squeal automatically or in response to action taken by the user, dolls that can emit more or less human-like vocal expressions, and in some cases, dolls that simulate wetting their pants so as to require occasional diaper changing, for example.

The effects of playing with such dolls is considered beneficial from an educational standpoint, i.e., such play enables children view themselves as small "mothers" learning about care for their "children" in the same way they have seen their adult counterparts care for real children. A sense of responsibility can be acquired or enhanced by reason of such playing.

As a result of the strong instincts of children to mimic adult behavior, there is also a significant educational opportunity presented by the use of toys or dolls which arouse and retain interest during the conduct of an educational process. In this connection, for example, instead of small dolls or toys, larger models such as mannequins or other lifelike figures are often used as teaching aids in a hospital setting or the like, as well as in a classroom setting wherein health, hygiene or the like subjects may be explored in detail with the help of model teaching aids.

Moreover, there is an awareness of the practice of changing body contours through exercise, such as "muscle-building" or "bodybuilding" on the part of both men and women. People generally, and certainly children, are aware of other conditions indicated by a change of body contour, the most common of which may be pregnancy. Less common conditions, such as certain diseases, may also be simulated by changing body contours.

Naturally, not only humans, but animals, may also be shown as gaining or losing weight, or undergoing change of bodily contour.

According to the present invention, advantage can be taken of the connection between weight gain or loss and dieting practices. The ability to create apparent weight gain or loss can be used as a response to simulated dietetic practices. In one particular embodiment, a child owning or playing with a doll of the invention, usually a female doll, can outfit the doll with clothing of a given size when the expansible volume between the interior body and the skin is negligible, and, as the doll appears to gain weight, notice the changes in the clothing as it becomes tight and ill-fitting. Such a development then logically calls for weight loss or new, larger size clothing. Especially where a child can obtain clothing of the larger size, necessary to accommodate the increased doll body size, and note the differences in the overall appearance of the doll, and the "cost" of weight gain. Of course, male or female adults may also use dolls, toys or models of the invention as a compelling way of visualizing the visual impact of their own weight gain or loss. In this context, the dolls can be used, as motivational aids.

Depending upon the construction of the doll and the desires of the user, the doll might typically undergo a volume increase corresponding to a number of dress or clothing sizes, followed by a reduction in size, going back as far as the original, uninflated or unexpanded size. In this connection, the expansion and contraction can be and usually are carried out under the control of a user. Depending on the degree to which the body will be clothed, and the degree of sophistication of the final product, the expansible volume may be defined by more or less realistic means.

Where the expansible areas will be largely or completely covered by clothing, the expansible volume may be defined by a relatively crude but inexpensive bladder arrangement, whereas in those instances wherein more skin exposure is desired or a higher level of realism is called for, the manner of achieving contour control may be varied. According to the invention, the degree of realism able to be attained is effectively limited only by the economics of manufacturing the doll, mannequin or toy product.

According to the preferred form of the invention, the doll or toy product is not one which requires inflation to achieve an initial size. There are at least two reasons for this. The first is that the original, basic or size, also sometimes herein termed a reduced size or smallest size, can be held constant, provided that the interior body is self supporting and relatively compression resistant. Hence, the doll product will almost always have a predetermined or original, initial size.

Second, by having an interior body that is relatively compression resistant, a firmer body texture is provided when the doll is not "overweight"; whereas upon weight gain, the doll, by reason of being inflated, may take on a more compressible or spongier, softer appearance in the outer layers, closely simulating a flabby or less developed, fatty exterior layer. Other reasons also favor this concept.

Referring now to the medium for filling the expansible volume, the simplest expedient is the use of air or like compressible fluid. Other non-compressible fluids or semi-liquid materials, such as watery or oily liquids may be used. Certain gels or gelable liquids may also be used under some conditions. In addition, it is also possible to achieve expansion by filling the space in question with an expansible, elastomeric material such as a compressed, open cell foam which is confined in a compressed condition within a bladder from which air is excluded. With such a construction, admission of air to the bladder or expandable space permits the expansible foam to tend toward and ultimately achieve its final, as-formed contour. Hence, the inventive concept is not limited to the use of any one or more means for expanding the body or for changing the volume between the exterior skin and the outer surface of the interior body.

While a more detailed explanation of a number of different constructions are referred to below, for purposes of summary, it will be appreciated that while it is possible have a single skin surrounding a single bladder covering the entirety of the doll body, such a construction is not always strictly necessary. The exterior skin may be made in one or more pieces, and the interior of the space may be defined by one or more bladders either separately inflatable or inflatable as a group. In some instances, the basic body may also contain the gas or like inflating agent. In such cases, there will be an expansible space between the inner body and the skin, but, as will appear, such space need not be a bladder in the sense of having inner and outer layers itself.

As will also appear, the material comprising the bladder and outer skin may be selected from a large group of materials; the bladder is preferably air- or liquid-tight and may be an elastomeric or non-elastomeric film. Control of size in either kind of bladder may be achieved by various of the constructions referred to in detail elsewhere. The skin itself may be air impermeable or may merely cover an air-impermeable bladder.

If the skin is impermeable, and the outer surface of the interior body is also impermeable, or if the body interior does not communicate with the outer atmosphere, then a separate bladder may not be needed. If a bladder of appropriate design is constructed, as will be described, it is possible to use a bladder with an existing toy, doll, or mannequin to achieve a variable-volume doll or mannequin. Consequently, the invention may be practiced by constructing a novel, body-contour-changing bladder of more or less complex shape and removably or non-removably associating it with an existing doll or mannequin.

The bladder itself may utilize the outer surfaces of the interior doll body as a part of the fluid containment system or the bladder itself may be entirely separated or separable from the interior body. A number of preferred variations are described and other variations will occur to those skilled in the art.

The principles of the invention may also be applied to formation of bladder or other spaces designed to change shape in simulating other forms of body growth. For example, simulating contour change in a body subject to muscle building exercise may be achieved by constructing the expansible areas only in the arm, leg, chest or back areas of a doll or toy figure, usually, but not always, the figure of a boy or a man.

Likewise, in a female toy or doll, pregnancy may be simulated by permitting a relatively large growth of the mid-section with little or no bodily expansion in other areas.

Inasmuch as the most common and most desirable method of achieving simulated weight gain will be through pneumatic inflation, an advantage of the inventive product is its compatibility with a wide range of inflation systems. The product may incorporate a built-in inflation system, such as, a pump that is responsive to arm or leg movement, or which can be manipulated by the user by pressing a selected area of the body or the head, for example. Likewise, exterior pumps of varying degrees of complexity may be used. A simple, bulb-type inflation pump of the type used in blood pressure cuffs may be used. A contoured spring may be used with hemispherical or other contoured exterior shapes forming the outer surface of a pump of the type used in inflating athletic shoes, for example. Piston, diaphragm or bellows-type pumps may be used, and may, but need not, form a part of the body or be incorporated therein. Electrical or mechanically operated "on board" or remote pumps may also be used, with or without associated inflation paraphernalia, such as needles of the type used to inflate basketballs or the like. Means may be provided for remote operation of the pump.

While the doll of the invention is intended to be inflated by a pump or the like, the exact type character or location of the pump is not in and of itself a novel feature. Such known pumps may be combined with the novel features of the invention so as to provide a product having overall novelty, however.

Referring again to the pumps, the invention is not limited to particular pump components nor does it depend on such components for novelty. Consequently, a check valve system might utilize a spring-loaded ball check valve, one or more duck bill valves, flapper valves, reed valves or the like, as well as more complex valving arrangements to secure air transfer from the exterior atmosphere to the interior of the bladder or other inflatable space.

Strictly speaking, a pump itself need not be used as the source of inflation, inasmuch as regulated or unregulated sources such as miniature compressed gas cylinders or the like may be used. Naturally, the degree of complexity embodied in the inflation system should be economically justified. In this connection, it is anticipated that a more complex system would be better justified in larger, more expensive dolls than in lower cost, less sophisticated models. Of course, economies of scale achieved in manufacturing may also be relevant to justifying the cost of more complex and/or realistic products.

In the present application, and in the claims, the expression "weight gain" or the like is taken in the illustrative sense. In other words, the doll or toy does not usually undergo a measurable, significant real weight gain in use, but merely undergoes inflation to a larger size in predetermined areas. Thus, the expression "weight gain" as used herein, does not apply to the actual gain in weight occasioned by addition of air or liquid to the product, but applies primarily to simulated weight gain resulting from an increase in exterior volume or change in contour relative to the doll, toy, or mannequin body.

Regarding simulated weight gain or loss, or other contour change, the invention also contemplates making and using and use accessories which either further demonstrate, or more fully take advantage of, the basic concepts of the invention. These accessories include faces with expansible "masks" that facilitate change of facial contour, simulated weight scales that appear to show weight change but that are really pressure gauges, "exercise machines" that can simulate weight loss by repetitively "exercising" the doll while gradually bleeding pressure from it, etc.

These and other accessories can heighten the illusion and/or effect of bodily contour change when used with the inventive products. Printed or display materials, such as menus, food value tables, and the like, as well as books and pamphlets can be used to heighten the user's interest in health-related subjects. Naturally, a highly important accessory is clothing in different sizes; this is a very dramatic way of showing "weight gain".

In this connection, variable volume mannequins may be made, whereby a single mannequin can serve to model or display clothing of various sizes for retailing purposes, for example. The illustrations made above have made reference to human figures as undergoing apparent weight gain or loss. However, it will be appreciated that the inventive concept is not limited to human figures, but is capable of simulating weight gain or loss or other change of bodily contour in animals such as pets, zoo animals, farm animals or the like.

In addition to the inventive concept itself, educational accessories of various kinds may be used in association or combination with the toys, dolls, animal figures or the like of the invention, in a manner which is explained in detail elsewhere herein.

In view of the failure of the prior art to provide a doll or toy figure capable of illustrating with comparative realism the phenomenon of weight gain, weight loss or other change of bodily contour in a human or animal, it is an object of the present invention to provide a toy, doll, or mannequin which can easily undergo a controlled change of exterior body contours to simulate weight gain or loss, "musclebuilding" or other change of condition.

Another object of the invention is to provide an improved doll product having application in teaching or reminding children or others of the importance of dietary control and good nutrition patterns.

Yet another object of the invention is to provide a doll which can undergo change of bodily contour between a first, given size, a second, significantly enlarged size and a range of sizes therebetween, with such changes being easily achieved under the control of the user or other operator.

A still further object of the invention is to provide a novel toy doll or the like having a life-like body form defined by an interior body made from a self-supporting, compression-resistant material, having an expansible fabric skin overlying the body and having means defining an expansible volume between the skin and the interior body to simulate weight gain or loss.

Another object is to provide a toy or doll as aforesaid wherein an increase in bodily size may be achieved by a simple pumping of fluid into an expansible space outside the interior body and inside or confining exterior layer.

Yet another object is to provide a doll product such as a mannequin or display model which is able to simulate the effects of dietary intake by undergoing a change in exterior body contours, and which may be sold, used or displayed in association with clothing, accessories, nutritional information materials, or other objects to illustrate or highlight changes in body contours occurring in response to changes in diet, exercise, or other achievable regimen.

A further object of the invention is to provide a toy or doll of the kind described wherein the user may simulate dietetic effects by undergoing a simulated dietary regimen followed by a caused or permitted reduction in the size of the doll exterior to a desired extent.

A still further object is to provide a doll or toy that includes a self-supporting interior, an inflatable bladder closely overlying the outer surface of the interior form and an expansible, elastic skin overlying the outside of the bladder, whereby, upon inflation of the bladder with a fluid under the control of an operator, the exterior skin expands away from the interior body form to achieve a new exterior contour simulating weight gain, for example.

Yet another object of the invention is to provide a doll or a body form or figure with a relatively compression resistant outer surface, a bladder overlying at least a portion of the surface and an elastic skin overlying the outer bladder surface.

A further object of the invention is to provide a toy or doll with an expansible volume or space between an interior body element and an exterior skin, constructed and arranged so that the skin has areas of differing expansion resistance under constant pressure, thereby enabling the skin to expand at different rates or to a different ultimate or transient volume in the presence of a constant internal pressure within the expansible space.

Yet another object of the invention is to provide a human figure, including a figure of life size, or of near life size, such as a mannequin or the like, for display or teaching purposes, including purposes of displaying apparent weight gain or loss to retail customers, students, or others who do not themselves wish to own or control the model or mannequin.

A further object of the invention is to provide an improved display product such as a product for use in advertising diet-related products or diet salon products or services and which can be remotely controlled or operated to undergo the expansion/contraction cycle referred to herein for demonstration purposes.

A still further object is to provide a bladder or the like which can be used with an existing or separately manufactured toy or doll to convert it into a product capable of undergoing a change of bodily contour.

Yet another object is to provide accessories for use with a doll, toy, or mannequin, which accessories can heighten or reinforce the illusion of contour change, or help effect such changes in its appearance.

A still further object is to provide a variable volume doll or mannequin that is compatible with a wide variety of inflation and/or inflation control systems, including built-in or remote inflation sources.

Yet another object is to provide a toy or doll product that achieves exterior change of contour through pneumatic inflation or fitting of an expansible space between a core exterior and a flexible outer skin instead of mechanical movement using complex mechanisms.

A still further object of the invention is to provide a life-like mannequin, model or like figure which can simulate changes in bodily contour for use in medical or health related educational programs.

Another object is to provide various methods of manufacturing controlled expansion products, including those having exterior contours that respond differently to the same increase in internal pressure.

A still further object is to provide a novel method of forming an exterior elastic skin overlying a base form or figure.

One more object is to provide a skin-forming method which includes applying adhesive and release coatings to the exterior of a base figure according to a predetermined pattern, then covering the base figure with a curable, air-impermeable material to form an exterior "skin" layer which will expand in the release areas and remain bonded in the adhesive areas, thereby providing an exterior surface with carefully defined areas of expansion.

The foregoing and other objects and advantages of the invention are achieved in practice by providing a doll having an inner body or core with an outer surface of a given contour, an outer skin covering the exterior surface, and an expansible volume or space between the outer core surface and the outer skin, with the skin being expansible through a range of positions, including a first skin position closely overlying the outer surface of the core, a second skin position substantially spaced from the body exterior, and a plurality of positions intermediate these first and second positions, so as to simulate a change in body contours. The invention may also be practiced by providing a separable bladder or suit arrangement capable of use with existing figures to achieve to above and other objects.

The invention also achieves its objects by providing variable exterior volume figures of various kinds, including humans, pets and other animals; accessories for such figures. Objects are also achieved by novel methods of making the dolls, toys or mannequins capable of achieving different exterior contours, to simulate weight gain or loss, or other change of bodily contour, with such methods including those directed to making elastomeric outer "skins" by using selected areas of adhesion and release between the "skin" and the affected body part.

The manner in which the foregoing and other objects and advantages of the invention are achieved in practice will become more clearly apparent when reference is made to the following detailed description of various preferred embodiments of the invention described by way of example and shown in the accompanying drawings, wherein like reference numbers indicate corresponding parts throughout.

BRIEF DESCRIPTION OF THE DRAWINGS

FIGS. 34–36 are schematic perspective views illustrating different steps in the practice of a novel method of the invention, wherein torsos or other parts of a body are made with an interior core and an exterior skin and with an expansible space defined therebetween;

FIG. 49 is a perspective view of a toy or doll figure that is inflatable to undergo apparent weight gain and loss and associated with an accessory in the form of a simulated weight scale;

FIGS. 50–51 are vertical sectional views of operative portions of the accessory scale mechanism of the invention.

DESCRIPTION OF THE PREFERRED EMBODIMENTS OF THE INVENTION

The present invention, as is apparent from the foregoing summary, and as will be more apparent from the following description, is capable of being embodied in a large variety of forms. Each of the different forms presently preferred for practicing the invention will be separately described, it being understood that various combinations of the individually described elements may be made without departing from the scope of the invention.

The terminology applied to the different components is not important to the practices of the invention. Thus, if a bladder system is used to provide the space, its outer surface can be the "skin", and it is not necessary that an additional skin be provided. In such a case, the outermost surface is in effect the skin, as well as a part of the bladder. The functional requirement of providing the inflatable space should be met, and while there is usually a requirement for providing "skin" in the sense of an outermost, confining layer, the appearance of the skin may be thought of as basically cosmetic, in the sense that a realistic "skin" adds realism and look better. Hence, the expression "skin" is usually used in the non-limiting sense as being the outermost portion of the structure, i.e., the one immediately surrounded by clothing, and is not necessarily an entirely separate component.

Figure 1:
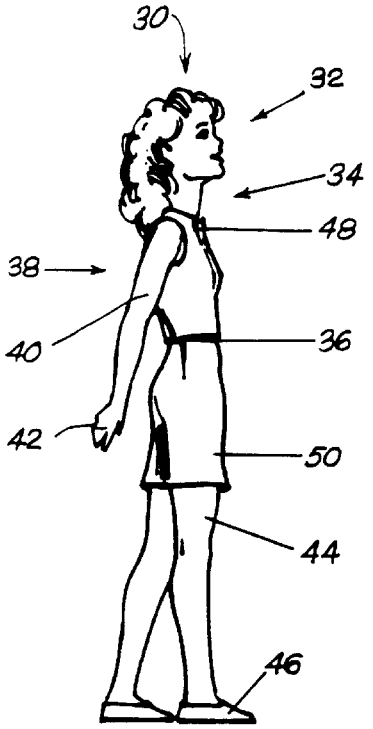
FIG. 1 is a side elevational view of a toy or a doll made according to the invention, and showing the toy or doll figure wearing a skirt and blouse and having a first, given exterior size.

Referring now to the drawings in greater detail, FIG. 1 shows a doll generally designated 30 and shown to embody the inventive principles. As appears in FIGS. 1–3, the doll assembly 30 includes a plurality of individual components, including a head generally designated 32, affixed by a neck 34 to the torso portion 36 of a body generally designated 38. The doll may be more or less lifelike, and accordingly includes arms 40, hands 42, legs 44 and feet 46.

Figure 2:
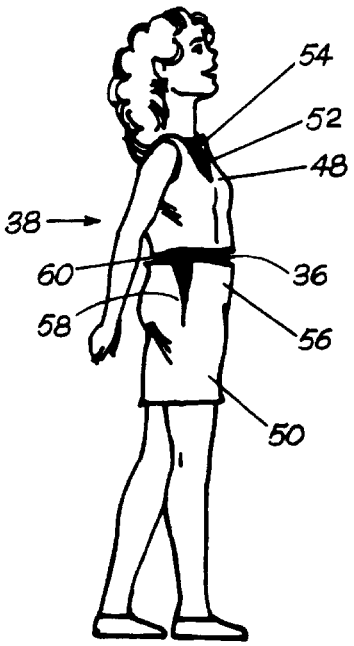
FIG. 2 is a side elevational view of the doll of FIG. 1, showing the doll body to be enlarged so as to have undergone apparent weight gain to a second, larger size and showing the skirt and blouse to be bulging outwardly because of the size increase.
Figure 3:
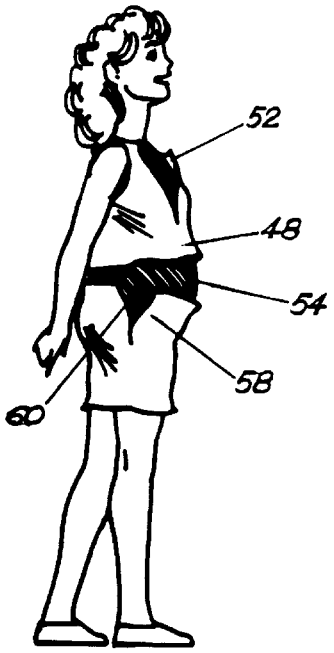
FIG. 3 is a side elevational view, similar to FIGS. 1 and 2 but showing the toy or doll figure in a fully expanded position demonstrating significant apparent weight gain and showing the clothing highly distorted and "popped open"

As shown in FIG. 1, the doll is clothed in a blouse 48 and a skirt 50. In FIG. 2, the same doll as is shown in FIG. 1 is illustrated, except that, in keeping with one embodiment of the invention, the torso portion 36 of the body 38 has undergone expansion, causing the sides of the blouse 48 to begin separating in the blouse placket area 52, with the result that unsightly gaps 54 are beginning to appear between the sides of the placket 52. The waist and upper hip portions 56 of the skirt are also shown in FIG. 2 as having become too tight for the skirt with the consequence that the fasteners in the skirt side opening or placket 58 have failed, permitting the skirt 50 to open in an unsightly manner, exposing the skin or undergarments 60. In FIG. 3, an extreme has been reached wherein the undergarments 60 are very much exposed, the blouse and skirt plackets 52, 58 have been fully open and the skirt and blouse are considerably spaced apart.

Figure 4:
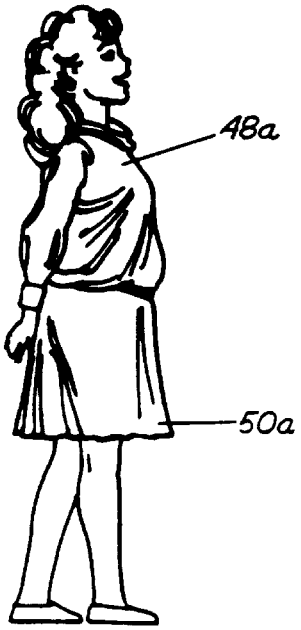
FIG. 4 is a side elevational view of the doll of FIG. 3, showing the doll or toy attired in larger size clothing, more appropriate to the increased doll size.

In keeping with the invention, and as shown in FIG. 4, the unsightly bulges have been covered by substituting a larger size blouse 48*a* for the smaller size blouse 48, permitting the elimination of strain on the placket and permitting the blouse 48*a* as a whole to assume a more acceptable, yet visibly enlarged shape. The counterpart skirt 50*a* is also properly sized for the new form, however, it will be appreciated that achieving the proper clothing fit for the doll as shown in FIG. 4, can be achieved only by providing the larger, less attractive sizes of blouse and skirt.

Hence, when the doll 30 undergoes the apparent weight gain just illustrated, the drawback of requiring new clothing of the appropriate size to be substituted is dramatically illustrated. In this manner, the user can graphically visualize the impact of weight gain, and note the less attractive aspect of baggier clothing. According to the invention, the apparent weight gain illustrated is reversible, in a manner which will be described later; thus, the doll may be manipulated after "weight gain" so as to achieve weight loss and revert to its initial size; then, the originally provided clothing will fit comfortably. According to the invention, there is an unlimited range of intermediate sizes between the largest and smallest possible sizes.

Figure 5:
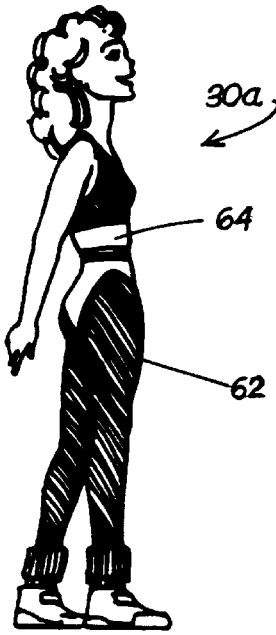
FIG. 5 is a side elevational view of a doll figure embodying the invention and shown to be attired in a snug-fitting exercise or "workout" suit capable of undergoing size expansion.

Referring now to FIG. 5, there is shown a doll 30*a* which is similar to that of the doll in FIGS. 1–4. However, for illustrative purposes, the doll is shown as wearing a clothing in the form of a close-fitting bodysuit 62 such as might be used for exercising. FIG. 5 shows that the "workout" clothing includes a snug-fitting but expansible waistband section 64 adapted to closely overlie the waist, a portion of the rib cage and part of the hip area.

Figure 6:
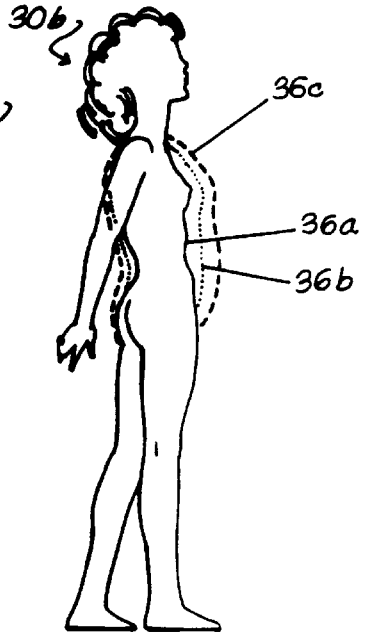
FIG. 6 is a side elevational view of a doll figure having phantom lines showing the potential for expanded size in the torso or mid section of the toy or doll.

Referring now to FIG. 6, there is somewhat schematically shown the portions of the doll of FIGS. 1–5 that can undergo dimensional expansion to simulate weight gain or loss. In FIG. 6, a doll figure generally designated 30*b* is shown as having an exterior torso contour 36*a* shown in solid lines that is expansible by stages to a larger contour 36*b* shown in broken lines and to a still further enlarged contour 36*c* also shown in broken lines. As will appear, means are provided according to the present invention to permit such expansion and to control the location and degree of such expansion.

Figure 7:
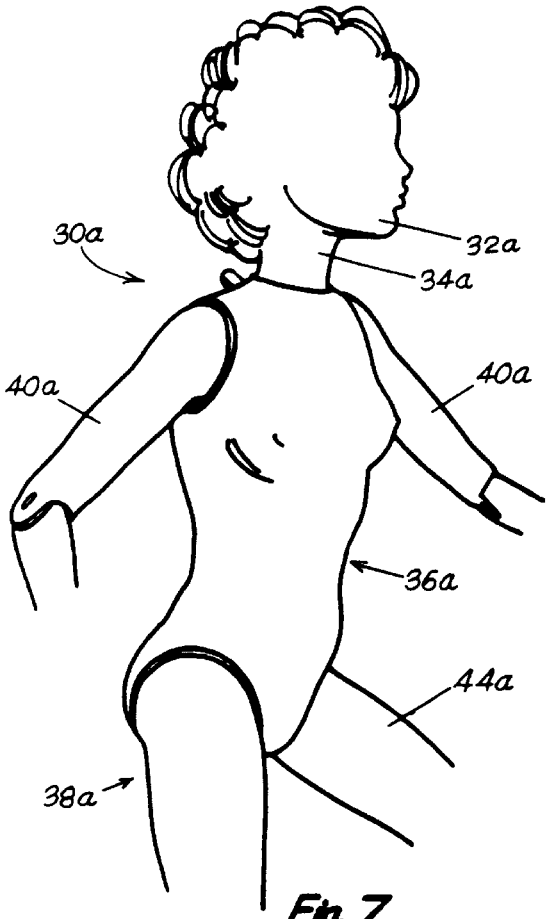
FIG. 7 is a fragmentary perspective view of the torso of a toy or doll figure of the present invention, showing the same in a given, base size.
Figure 8:
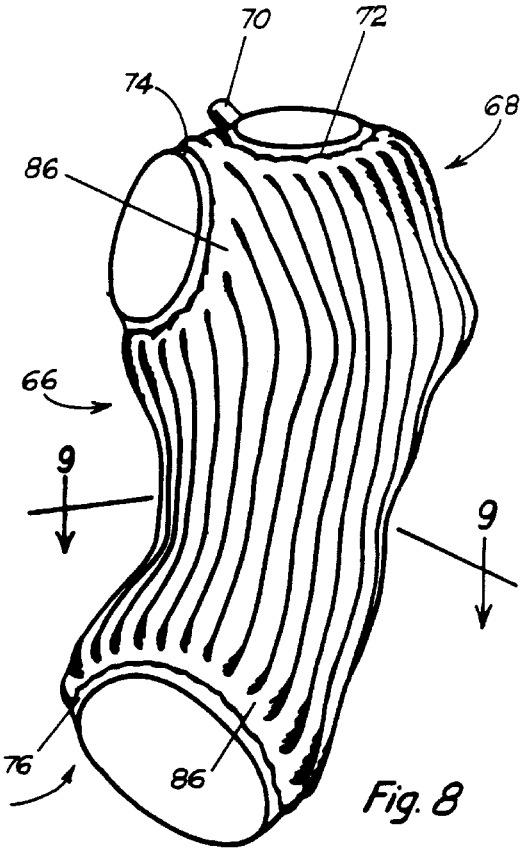
FIG. 8 is an enlarged perspective view of a portion of a portion of the torso of the doll of FIG. 7, fitted with an overlying inflatable bladder adapted to undergo inflation and change of exterior size.
Figure 9:
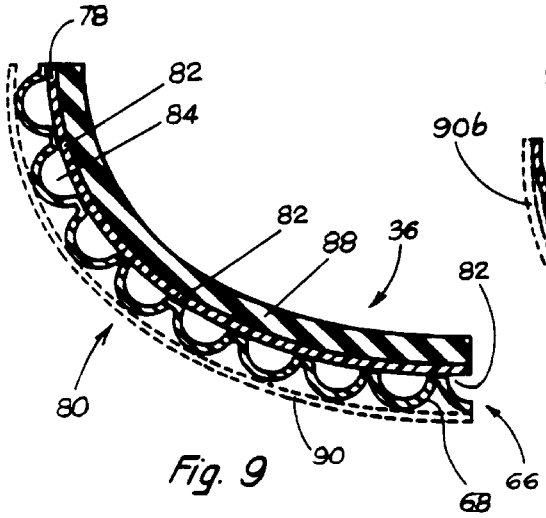
FIG. 9 is a fragmentary vertical sectional view, taken along lines 9—9 of FIG. 8 and showing a section through a doll body having one form of expansible bladder overlying the torso, with the bladder being covered by an exterior elastic cloth "skin" shown in phantom lines.

FIGS. 7–9 show one extremely low cost way of providing simulated dimensional change such as weight gain or loss in the torso portion of the body. According to the invention, any desired part of the body may be made to simulate weight gain or other contour change in keeping with the invention; however, the various ways of achieving these objects are referred to elsewhere. Where "weight gain" is referred to, it will be understood that such "weight gain" is apparent weight gain due to expansion; similarly, "weight loss" refers to reduced dimensions or deflation. Both gain and loss are intended to be included in the general expression "weight gain", unless specifically stated or otherwise implied from the context.

Referring now to FIGS. 7–9, there is shown one form of doll generally designated 30*a* having a torso 36*a* with which an expansible bladder generally designated 66 may be used in practicing the invention. The torso 36*a* of the doll body generally designated 38*a* may be made from any suitable material, provided only that, for this form of doll, the material is rigid enough to be substantially self-supporting, and that the exterior surfaces of the body are relatively incompressible. By this is meant that, when subjected to pressures of the sorts to be discussed herein, but typically of the order of only 1–4 psi or less, the body will not materially deform to a smaller volume in relation to the outward expansion or deformation undergone by the exterior skin.

In FIG. 7, the torso 36*a* of the body 38*a* has attached thereto the arms 40*a* and legs 44*a* referred to above, as well as the head 32*a* supported by a neck 34*a*. Because it is the center or torso portion 36*a* of the body that is intended to support an expansible bladder in this embodiment, the generic expression "core" is used herein and in the claims, to describe that part. The expression "core" therefore means whatever portion of the toy, doll or mannequin body that supports an expansible overlayer. While the core is the torso 36*a* in this embodiment, it may be another piece, or several pieces, in other embodiments.

Referring now to FIG. 8, an expansible bladder 66 is shown positioned over the torso 36*a*. The bladder 66*a* includes a ribbed outer surface generally designated 68, and air inlet tube generally designated 70 and shown to communicate with the interior of the bladder near the rear of the neck-forming margin thereof. The bladder 66 includes marginal areas 72, 74, 76 lying generally adjacent and defining openings for the areas to which the arms, legs and neck 40*a*, 44*a*, 34*a* will be attached to the torso 36*a*. In the embodiment shown in FIGS. 7–10, the bladder 66 is chosen for low cost and ease of production; in this embodiment it includes inner and outer, air-impermeable layers 78, 80, respectively. The inner layer 78 is preferably, in the interests of economy, made from a heat sealable thermoplastic film such as polyvinylchloride ("PVC"). The outer layer 80 is made from a similar material in which a plurality of generally parallel seams 82 are provided by heat sealing selected spaced apart attachment areas of the outer layer 80 to the inner layer 78, to provide a plurality of vertically extending air spaces 84. The heat sealed or seamed areas 82 extend throughout a significant portion of the bladder, but terminate short of the neck and limb opening margins 72, 74, 76 thereof. Annular, seam-free margins 86 extend about these openings and not only serve as manifold to permit passage of air into the various pockets or chambers 84, but also permit the marginal sections 86 to be inflated.

FIG. 9 shows that whereas the inner layer 78 closely overlies an outer wall 88 of the torso 36, a flexible, elastic skin 90 overlies and surrounds the ribbed outer surface 68 of the bladder. The exterior skin 90 is made from an elastic material, preferably a "stretch" fabric and is constructed and arranged so as to snugly engage the outer wall 88 of the torso 36 when the bladder is empty, to permit gradual expansion of the bladder 66 as it is inflated. Thus, the skin will move outwardly in response to the uniform pressure within the various sections 84 of the bladder. When the bladder sections are fully inflated, as is shown in FIG. 9, the maximum exterior size has been reached, and no more expansion will occur. This is because, in the low cost embodiment being described, the bladder itself is made from a non-elastic material such as a sheet of plastic film. Its outermost dimensional expansion is therefore limited by its contours in the fully inflated position. Because the outer skin is elastic, it will assume a range of lifelike positions between the fully inflated and deflated extreme positions of the bladder 66.

Referring now to the arrangement of the seams 82, these are selected so as to control the nature and degree of expansion. For example, the described embodiment shows several rib-forming seams 82 running vertically in the mid-section of the torso. Control of outside surface expansion is achieved by a combination of seam spacing and extra or slack material. Thus, if a large expansion potential is provided, the seams are spaced relatively farther apart and more slack material is provided between the seamed areas; if the seams are closely spaced and very little slack material is provided, expansion is limited. Accordingly, the combination of overall area of the outer bladder layer and its seam patterns predetermine the degree of potential expansion. Typically, therefore, seams and material are arranged to provide a smaller expansible volume at the back of the body than in the front. As pointed out, the elastic skin 90 expands only in response to pressure and, to a certain extent, can disguise the rib-like appearance created by the individual air spaces or chambers 84.

Figure 10:
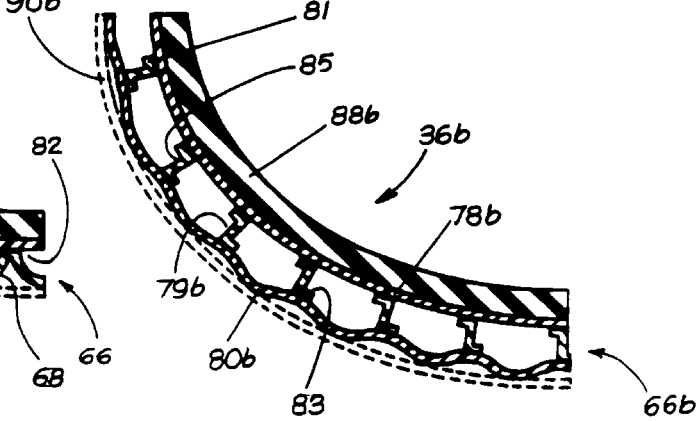
FIG. 10 is a view of an a modified form of inflatable bladder and cover "skin" similar to that of FIG. 9.

Referring now to FIG. 10, a slightly modified form of bladder 66*b* is shown with a torso 36*b* which includes an outer body wall 88*b*. Here, the inner bladder layer 78*b* is similar to that of its counterpart in FIG. 9. The outer bladder layer 80*b* provides a less visibly ribbed appearance because, instead of being seamed directly to the inner bladder layer 78*b*, it is attached to the inner layer 78*a* through intermediate fastening means in the form of "Z-strips" generally designated 79*b*. Each Z-strip 79*b* resembles a "Z" in cross section and has inner and outer seaming margins 81, 83 and a center section 85. In this instance, the positioning and length of the Z-strip center section 85 helps determine the contour of the outer layer 80*b* of the bladder 66*b*. Again, a similar elastic layer 90*b* is provided in closely overlying confining relation to the outer layer 80*b*. A toy or doll product having a bladder 66*b* such as that shown in FIG. 10 operates in the same way as does its counterpart in FIG. 9. The number and location of Z-strips 79*b* selected will help determine the exterior size and shape of the toy or doll when inflated.

While it is possible to do away with the rib-forming seams 82 or its Z-strips 79*b* altogether, these provide preferred ways of locating the outer skin relative to the inner skin for controlling expansion, adding realism, and for other reasons.

Figure 11:
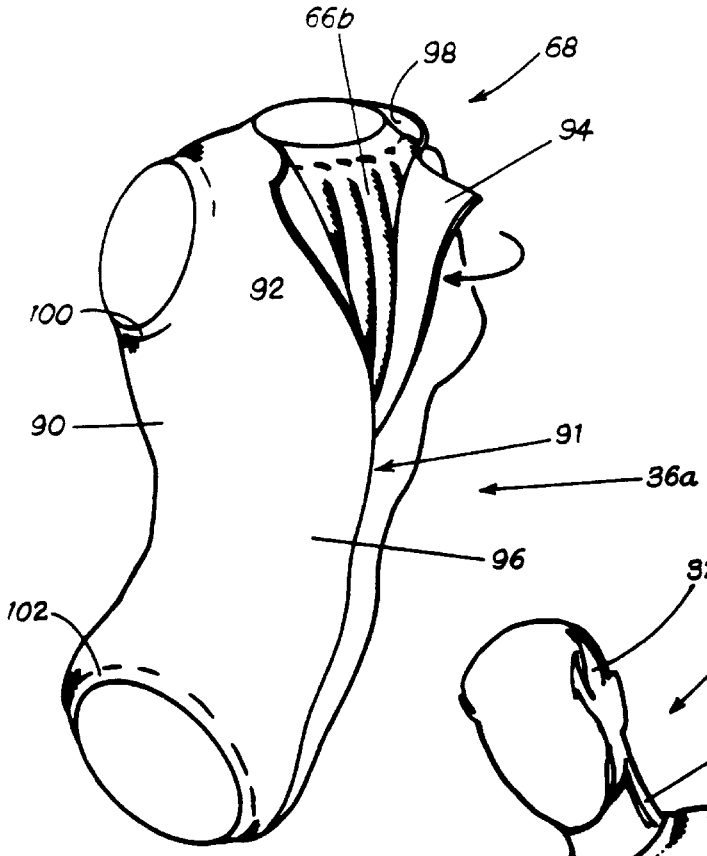
FIG. 11 is a perspective view of a form of expansible-torso doll of the type shown in FIG. 7 and 8, and showing a removable elastic exterior "skin" positioned over the expansible bladder.

Referring now to FIG. 11, there is shown the torso 36*a* of FIG. 7 covered by the bladder 66 or 66*b* that is in turn covered by the exterior, form-fitting elastic "skin" 90, 90*b* shown in the section in the foregoing figures. In the illustrated embodiment, the expansible or elastic skin fabric 90 preferably have the appearance of human skin and is of a suitable skin color.

As is further shown in FIG. 11, the skin 90 has a center seam generally designated 91 that is formed by overlying the respective adjacent margins 92, 94, to create a form-fitting skin garment 96. These margins may be sewn, heat sealed, or attached to each other by hook and loop ("Velcro") fasteners. Depending upon the degree of realism sought, the bladder 66, 66*b* and its skin covering 90 may more or less closely follow the contours of the torso. FIG. 11 shows that margins 98, 100, 102 define neck and limb openings in the skin garment 96.

In use, when the outer "skin" is in place as shown, the elastic force of the skin is sufficient to compress the deflated bladder into a position closely overlying the outer surface of the outer body wall 88, or 88*b*. As the inflation pressure supplied through the tube 70 (FIG. 7) increases, the bladder begins to expand, overcoming the inwardly direct ed confining load of the snug-fitting skin 90. As pointed out, those embodiments, wherein the bladder material is non-elastic, the limit of expansion is determined by the size of the outer bladder layer and the seaming pattern. The bladder expansion limits are reached when all of the inflated members are strongly in tension.

FIG. 11 shows the outer skin 90 as being in the form of a vest, jacket or like garment 96 with a single center seam for purposes of illustration. A commercial product may be made by utilizing a completely knitted or woven sleeve having no seam, if desired. As a preferred alternative, to enhance the appearance of the product, the seam is placed on the back rather than the front surface of the toy or doll product; the seam 91 is shown in detail on the front of the body only for purposes of illustration.

Figure 12:
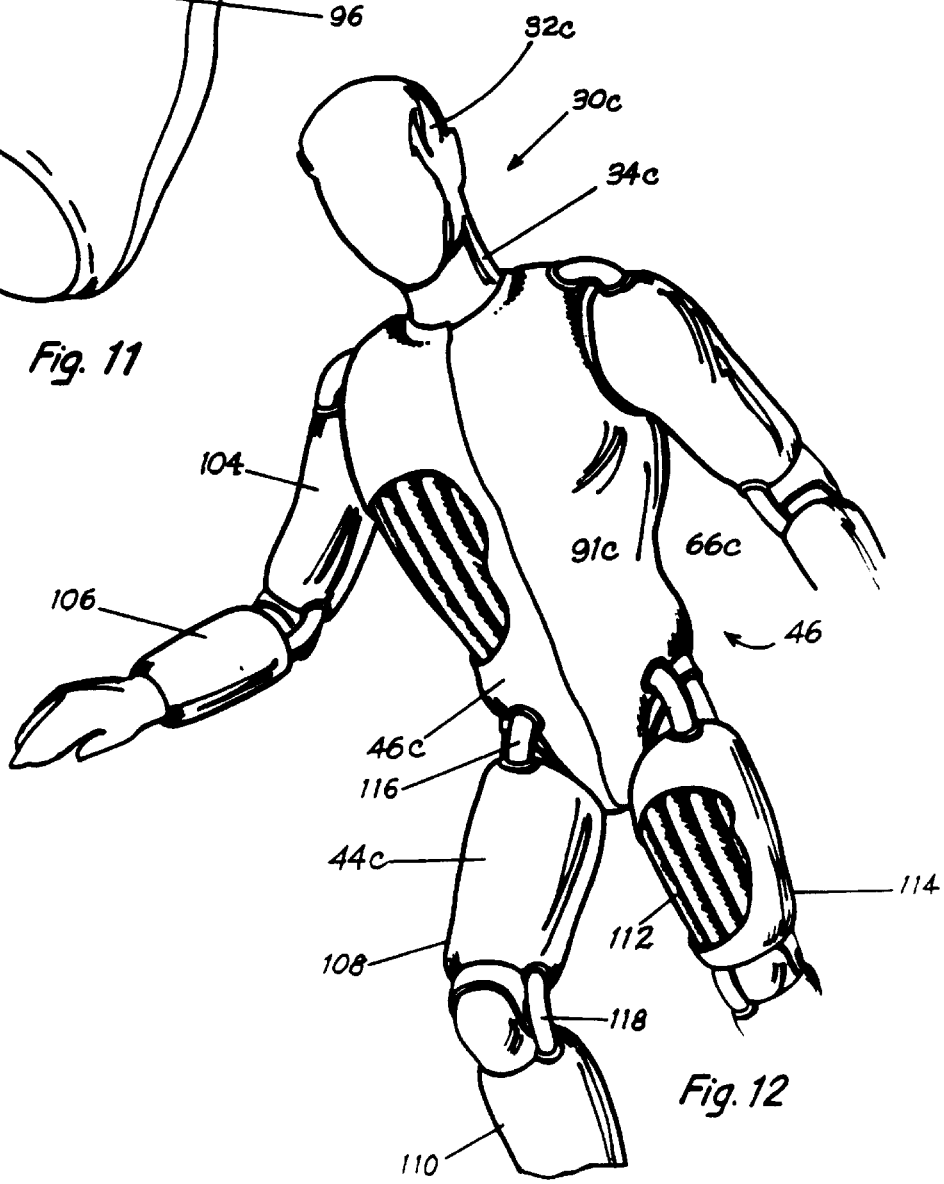
FIG. 12 is a perspective view, partly schematic in nature, showing the body of a toy or doll having plural, interconnected, inflatable bladders, each of which is covered by an elastic "skin" section.

It being apparent from the foregoing description that an inexpensive manner of making the inventive product is to provide a non-expansible bladder covering the torso and in turn covering that bladder with an elastic skin, FIG. 12 shows a further refinement of this concept. Here, the figure generally designated 30*c* has the head 32*c*, the neck 34*c*, legs 44*c* and other constituents corresponding to those of its counterpart in FIGS. 1–6. The principal difference between the embodiment of FIG. 12 and that of FIGS. 7–11 is that the expansible bladder concept is applied by providing plural, separable bladders for body areas in addition to the torso.

In this case, in addition to the expansible body center section 66*c*, left and right hand shoulder/upper arm sections 104 and forearm sections 106 are shown. In addition, left and right hand thigh and calf sections 108, 110 are to be provided.

Each expansible section is conceptually similar; each includes a core part, a bladder and an outer skin. One typical section is the thigh section 108 that is shown to include a thigh bladder 112, and an outer skin section 114. Upper and lower connector tubes 116, 118 extend from the thigh bladder 112 for communicating respectively with bladders in the calf section 110 and the torso section 66*c*. It will be understood that as long as the toy or doll includes a skin section for each of the inflatable bladders, and provided the bladders are interconnected through the tubes, inflating one bladder will cause eventual filling and expansion of all the bladders. This, in turn, will cause outward movement of the skin sections simulating weight gain, muscle building or other bodily contour change. It is a matter of choice as to how many such bladders may be provided, and as to whether the skin covering the bladders is a single skin for the entire toy figure, a single skin for each bladder section or a skin for more than one but less than all of the bladder sections. Each skin section may have a seam such as the seam 91*c* or may be a single piece woven tube or the like. As long as the skin is elastic, the doll or toy may take on a more or less lifelike appearance during apparent weight gain. For illustrative purposes, FIG. 12 shows interconnecting tubes such as the tubes 116, 118 as being of relatively large cross-section and somewhat visible. It will be understood that, with an inflation medium such as air being provided, the actual size of the interconnecting tubes may be so small as to render them inconspicuous or invisible as a practical matter.

Figure 13:
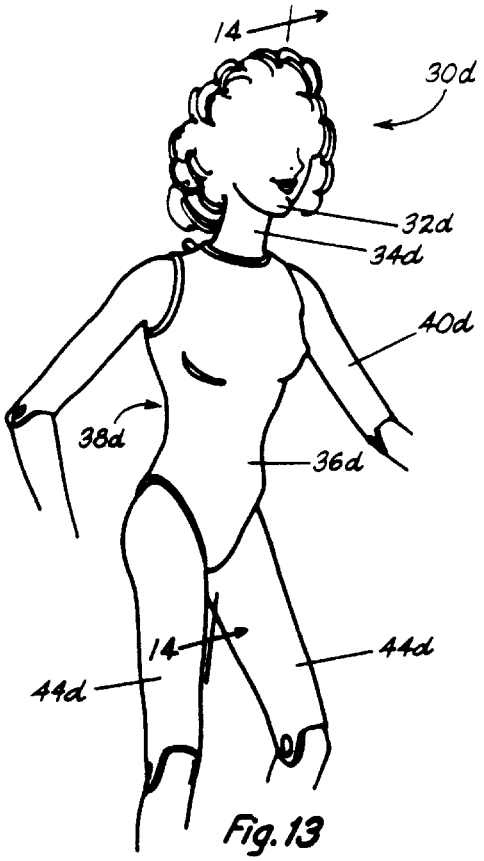
FIG. 13 is a perspective view of another form of doll made according to the invention and showing the same in a slender or "low weight" configuration having an elastic exterior skin covering a non-inflated bladder.

Referring now to FIG. 13, another form of toy or doll generally designated 30*d* is shown. Again, this toy or doll figure includes a head 32*d*, a neck 34*d*, a body generally designated 38*d* and shown to include a torso 36*d* to which arms 40*d* and legs 44*d* are respectively attached.

Figure 14:
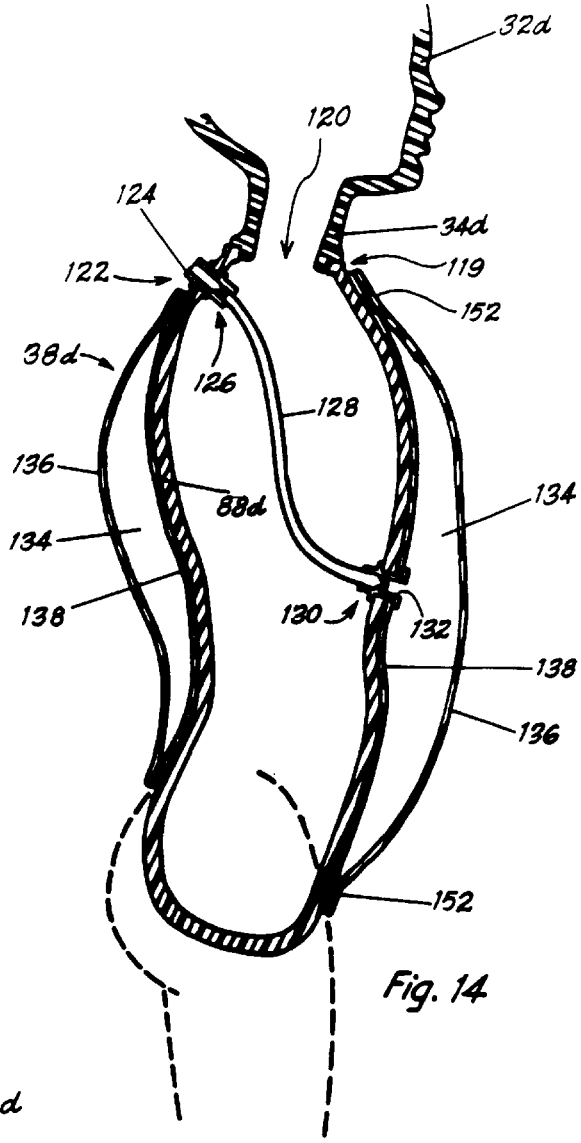
FIG. 14 is a vertical sectional view of the doll of FIG. 13 with the bladder inflated and showing the operation of the inflation system and the positioning of the bladder relative to the torso.

Referring to FIG. 14, a vertical sectional view of the form of doll body of FIG. 13 is shown. This body 38*d* includes a comparatively rigid outer wall 88*d* having an upper margin generally designated 119 and defining an opening generally designated 120 for receiving a rotatably mounted neck 34*d* having a head 32*d* attached thereto. Adjacent the upper margin 119 of the body wall 88*d* is an inflation and pressure retention fitting generally designated 122 and shown in FIG. 16 to include a generally tubular body 124, serving to locate a duck bill valve generally designated 126 and a connector hose 128. The connector hose 128 terminates at a second, center body fitting generally designated 130 and shown in FIG. 17 to have an outlet passage 132 communicating with an expansible space 134 lying between an outer, elastic, air-impermeable skin 136 and an impermeable inner liner or coating 138 overlying the body wall 88*d*. In the illustrated embodiment, the elastic, air-impermeable skin 136 extends over substantially all of the torso except for the neck and limb attachment areas and the lowermost body portions. An impermeable liner or coating 138 covers the same areas, so that, with the margins sealed together, the expansible space 134 is air-impermeable and has an elastic outer skin 136.

Figure 16:
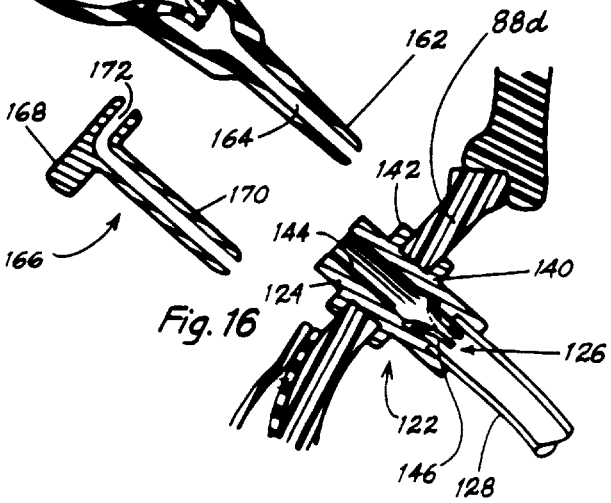
FIG. 16 is an enlarged vertical sectional view of the inflation valve arrangement of the doll of FIGS. 13 and 14, showing the valve operation and a pressure release unit adapted to bleed air from the interior of the inflated bladder.
Figure 17:
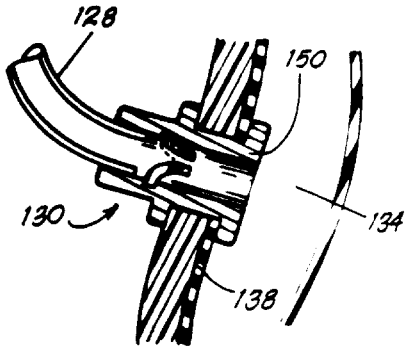
FIG. 17 is an enlarged sectional view of a portion of the doll of FIGS. 15 and 14.

FIG. 16 shows that the combination inflation and pressure retention fitting 122, in addition to the body 124 includes locking flanges 142 for engaging an opening in the body 88*d*, and an inner wall section 144 defining a center passage in which the valve 126 is positioned. The passage is intermittently closed off by contact between the petals 146 of the reed or duck bill valve 126 referred to above. FIG. 17 shows the counterpart fitting generally designated 130 and shown to be similar to its counterpart except that its outlet end 150 may be substantially flush with the surface of the coating 138 on the torso body 88*d*. No valve is provided in the fitting 130.

In the illustrated (FIG. 14) form of the invention, the torso body 88*d* is shown to be covered with an air-impermeable coating 138. This may be a shrink film or the cured form of a coating applied in the liquid state; it may also be a suitably formed and subsequently attached resinous plastic shell such as one made by vacuum forming or the like. Because its only purpose is to ensure that the center section or torso 36*d* has an outer surface which is impermeable to air, if the body wall 883 is already impermeable, the coating or liquid 138 may be eliminated.

The exterior skin 136 is made from a material that is both air-impermeable and elastic. Such a material may be a reinforced rubber material, or a woven fabric material having an interior latex or other flexible but impermeable coating, or may be any other material that will remain both air tight and capable of undergoing repeated expansion and contraction cycles. Assuming such a material to be a fabric, and further assuming it to be positioned over the torso as shown in FIGS. 13 and 14, then movement of air through the passage 144 under pressure will open the reed or duckbill valve, pass through the hose 128 and the second fitting 130, and inflate the space 134 between the skin and the outer surface of the body 88*d* serving as the core.

In this embodiment, the elasticity of the skin is the only factor limiting the expansion potential. Preferably, the skin is affixed about the neck and arm openings as shown in FIG. 13 and may be pre-stretched or made to conform closely to the back surface of the body. Consequently, upon inflation, the front sides and rear portions of the body will expand, but the larger, unsupported front surface will expand to a greater extent and closely mimic weight gain in a human figure. In the embodiment shown, openings such as those 120 for affixing the neck, or for affixing the arms or legs may be included without such openings providing a potential leakage path. In other words, the center of the torso may be open to the atmosphere and the expansible space comprises only the space between most of the torso exterior and the skin covering it. As shown in FIG. 14, adhesive or heat seal connections 152 are made between the margins of the skin and those of the liner and/or selected portions of the torso 36*d*.

Figure 15:
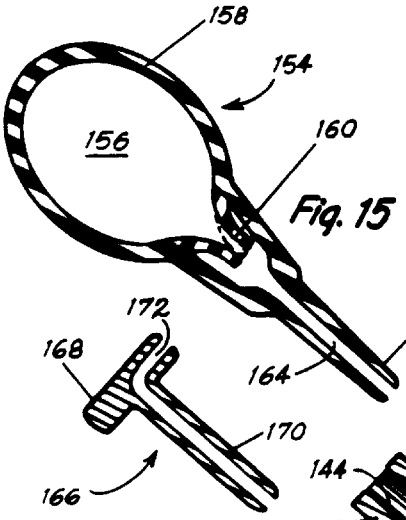
FIG. 15 is a vertical sectional view, partly schematic in character, showing a representative inflation device usable with various embodiments of the toy figure of the invention.

FIG. 15 schematically shows a simplified pump in the form of an inflating bulb generally designated 154 which is suitable for practicing the invention. This pump 154 includes a center cavity 156 enclosed by an outer bulb wall 158 having portions for receiving an outlet duck bill or reed valve 160, and a narrow, elongated nose portion 162 having a central air passage 164 extending therethrough. In use, the tubular wall 162 is inserted into the fitting 122 where it forms an air-tight fit with the fitting wall 144. Squeezing the bulb creates an air pumping or displacement action which opens the duck bill or reed valve, permitting air to flow into the space 134 between the skin and the body. The pump 154 has been illustrated as having one duck bill or reed exhaust valve, it being understood that a counterpart intake valve (not shown) is also used. It is also understood that any other suitable type of air pump may be used, including the bulb type used with a blood pressure cuff, a miniature bicycle or football pump, for example, or any other suitable unit.

If there is an air seal between the outer surface of the pump nose and the fitting, then the interior valve need not be opened by direct physical engagement. On the other hand, if the duck bill or like valve is strongly biased closed by its own inherent elasticity, as would be the case in a football or basketball bladder, then mechanical contact is used for initially opening the valve and leaving it open during the inflation cycle.

While it is therefore not always necessary to mechanically bias the check valves to an open position for inflation, it is usually necessary or preferred to do so during deflation. Thus, if the check valve selected is of the duck bill or reed type which is inherently biased closed, then a pressure relief insert such as the tool 166 may be used for deflation. This relief unit 166 or bleed valve has an enlarged head portion 168, a long shank section 170 and a center air vent passage 172 terminating at one side of the insert 166. Lowering the pressure in the doll to simulate weight loss is achieved by simply pushing the shank 170 of the insert 166 into the fitting until the valve 126 is wedged open and permitting a desired amount of air to escape. If the center passage 172 is made of a sufficiently small size, close control over the rate of bleed down or "weight loss" action may be maintained.

Figure 18:
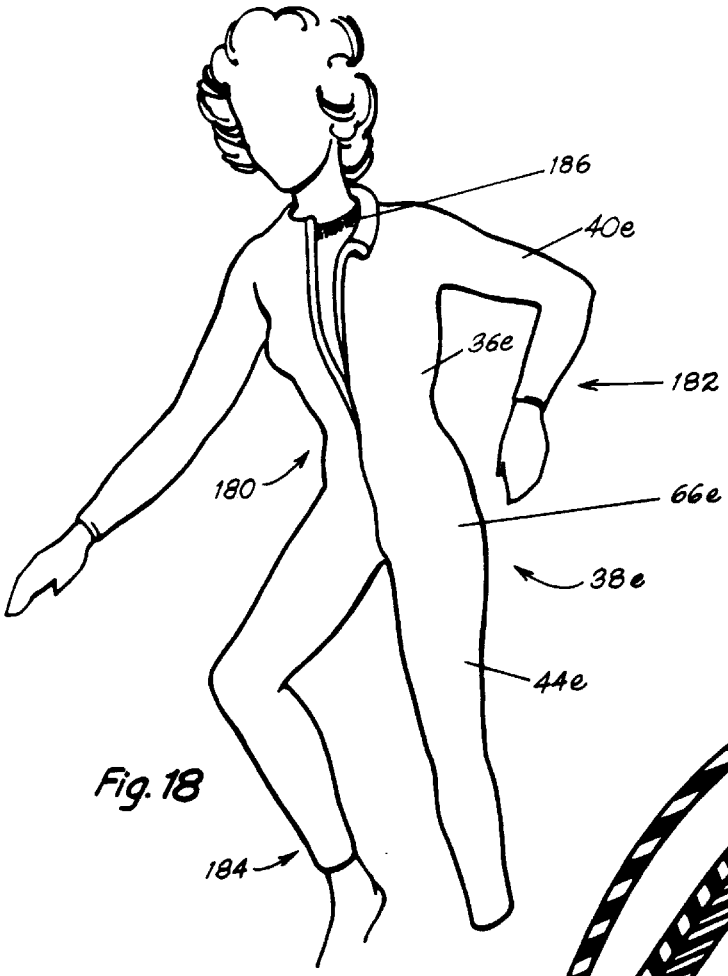
FIG. 18 is a perspective view of a still further form of toy or doll figure showing the relation of the exterior skin to the inner body thereof.
Figure 19:
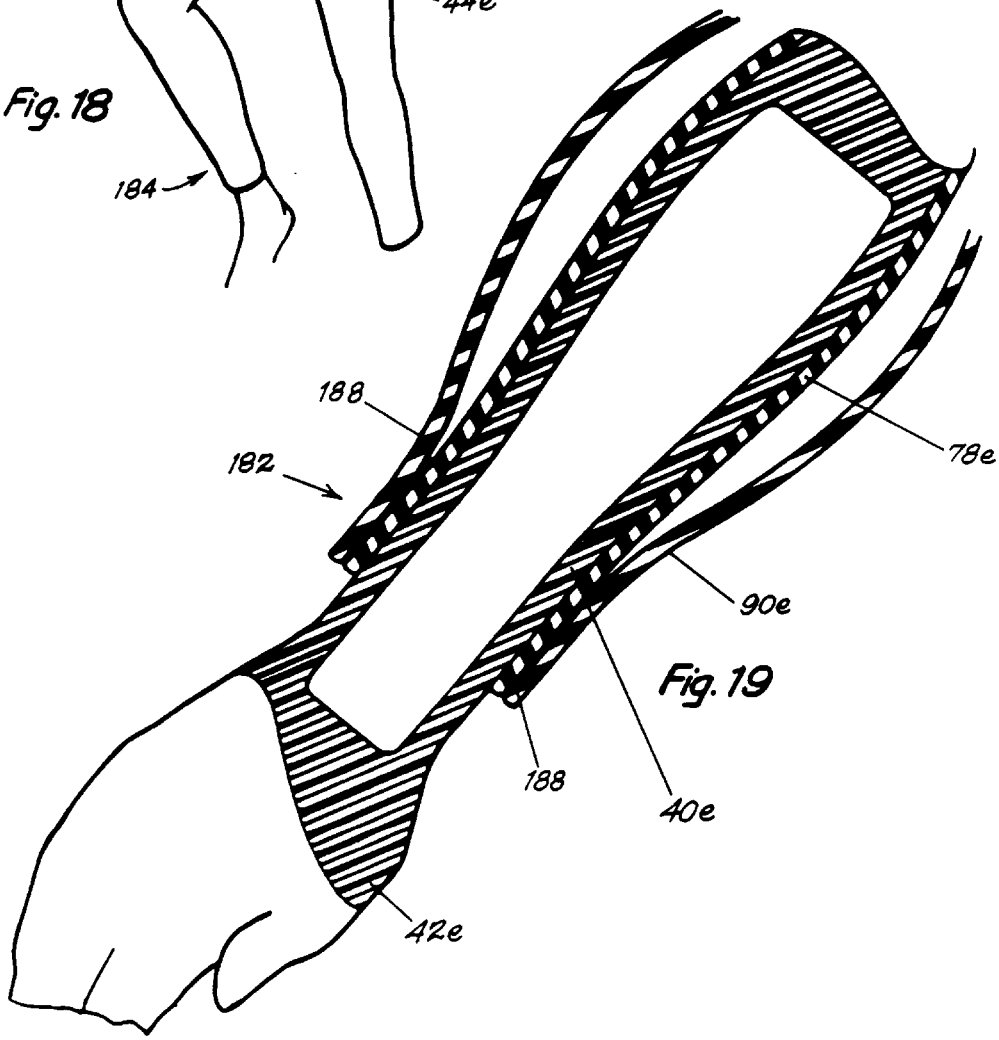
FIG. 19 is a fragmentary vertical sectional view of a hand portion of the doll of FIG. 18, showing the constructional details of a doll body and the inflatable bladder used in practicing the invention.

Referring now to FIG. 18, a different embodiment of the invention is shown. Hence, a single, inflatable "body suit" or "jumpsuit" 180 provides both inner and outer layers of the expansible space. In this embodiment, the toy or doll inner body 38*e* has its arms 40*e*, legs 44*e* and torso 36*e* covered by a single, two-layer bladder 66*e*, i.e., a bladder wherein the outer skin 90*e* is joined to the inner layer 78*e* each other along various margins such as at the arm and leg cuffs generally designated 182, 184 and the neck margin 186 so as to create a single bladder that covers the entire body 38*e*. FIG. 19 shows the doll hand 42*e* and arm 40*e* made from a single piece, and shows an adhesive attachment area 188 where the facing surfaces of the inner layer 78*e* and the outer skin 90*e* meet.

By appropriately locating these seams 182, 184, 186, and a center seam 91*e*, a suit can be manufactured in such a way that, once completed, it may be made to cover virtually the whole exterior of the doll body serving as a cove or mandrel. While FIG. 18 shows a center or vertical seam 91*e* for the outer skin 90*e*, it is understood that one or more counterpart seams are provided for the inner layer 78*e* also. In this connection, making the inflatable bladder/suit as a single unit can add considerable realism to the doll body albeit with the drawbacks of complexity and increased expense. By combining the bladder and exterior skin into a single unit or one-piece "jumpsuit," the design becomes readily adaptable to a doll with movable limbs, and provides a reliable, leak-proof construction, provided appropriate materials are used.

In the example just described, the inner layer 78*e* of the bladder 66*e* may be made from a non-expansible thermoplastic material made from an impermeable elastic material and the exterior skin portion 90*e* may be made from an elastomeric, air-impermeable material such as rubber, or rubberized fabric. Both layers may be made from an elastic material, or, if the bladder is made from an elastic material of an inappropriate texture or color, a second exterior skin may be added.

In use, a doll of the type just described holds out the potential greater realism than the doll with a two-layer bladder and a separate skin. The integral skin adds realism. Additional control over the amount and/or location of expansion or "weight gain" may be achieved extrinsically by the use of belts or the like, which can also serve to demonstrate the truth, that, in attempting to confine body contours by the use of belts or girdles, when a bulge is eliminated in one place, it often simply appears in another location. Because bladders of the type just described have relatively large, uninterrupted volumes, a doll made as just described has the above and the further advantage of simulating a softer or more "flabby" appearance than does a doll with only a relatively small, air chamber.

Referring now to the skin type covering for this form of product, a one-piece skin cover having sealable areas for the provision of seams may be made in a known manner, i.e., creating seams upon assembly by the use of hook and loop ("Velcro") seaming material, heat sealing, sewing, or the like. The preferred technique may also depend on the size of the doll.

In describing the foregoing specimens of toys or dolls, it has been assumed that a single manufacturer would produce the toy or doll product. However, the concept of the invention is also applicable to producing "conversion kits" whereby a weight gain or loss feature may be added or adapted to existing toys or dolls. In this connection, using the inventive concept, it is possible to manufacture an add-on or "jumpsuit" expanding bladder/skin product for use with an existing core in the form of a doll or toy body. Thus, a doll owner might convert an existing toy or doll to a weight gain/weight loss toy by the use of the kit. In addition, a manufacturer might have the core or body made in one location or operation and add the weight gain/loss feature at another location or through a subsequent operation.

Figure 20:
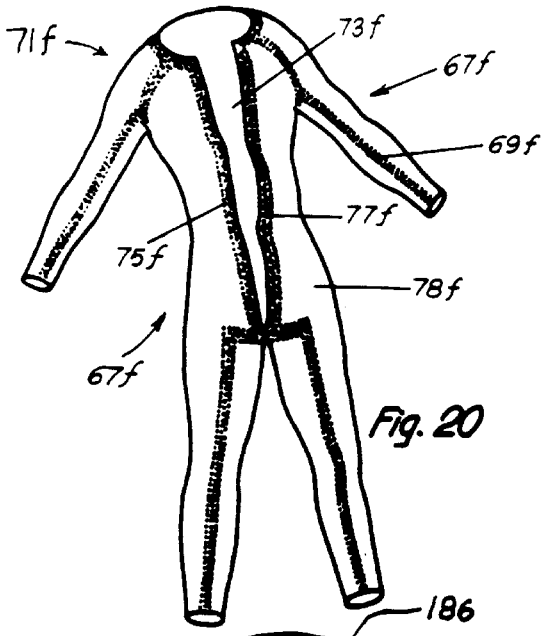
FIG. 20 is a perspective view of the inner layer of a two-layer "body suit" or "jumpsuit" adapted to form an inflatable bladder system for use in association with a separately manufactured doll or toy figure.
Figure 21:
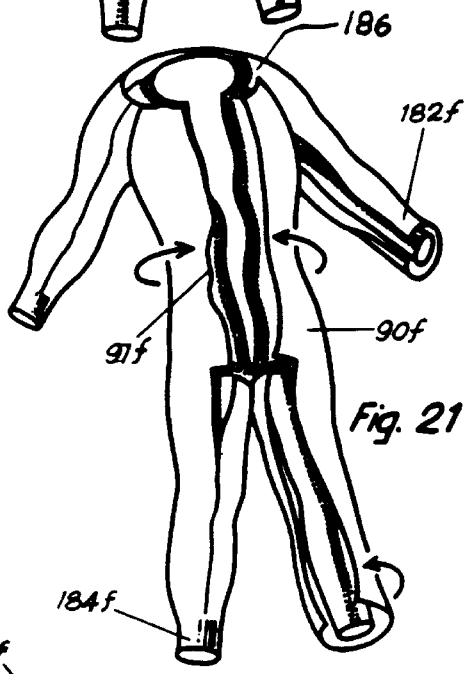
FIG. 21 is a perspective view showing the positioning of an exterior layer in overlying relation to the inner layer of a bladder unit for use with a toy or doll figure.

Such a concept is shown in FIGS. 20–23. Here, FIG. 20 shows an interior layer 78 made in the form of an entire suit 67*g*. The stippled area 69*g* in FIG. 20 show seamed areas illustrating the manner in which the inner layer 78*f* of the suit 67*f* may be made. The exact location of the seam areas is not critical to the practice of the invention, but the seams are shown to illustrate that a unitary inner layer is made, being substantially closed except for an insertion opening generally designated 71*f* comprising a neck margin 186 and a opening 73*f* established by left and right hand side margins 75*f*, 77*f*. Preferably, the suit just described is made from a material which is at least somewhat flexible and which is completely air-impermeable.

Figure 22:
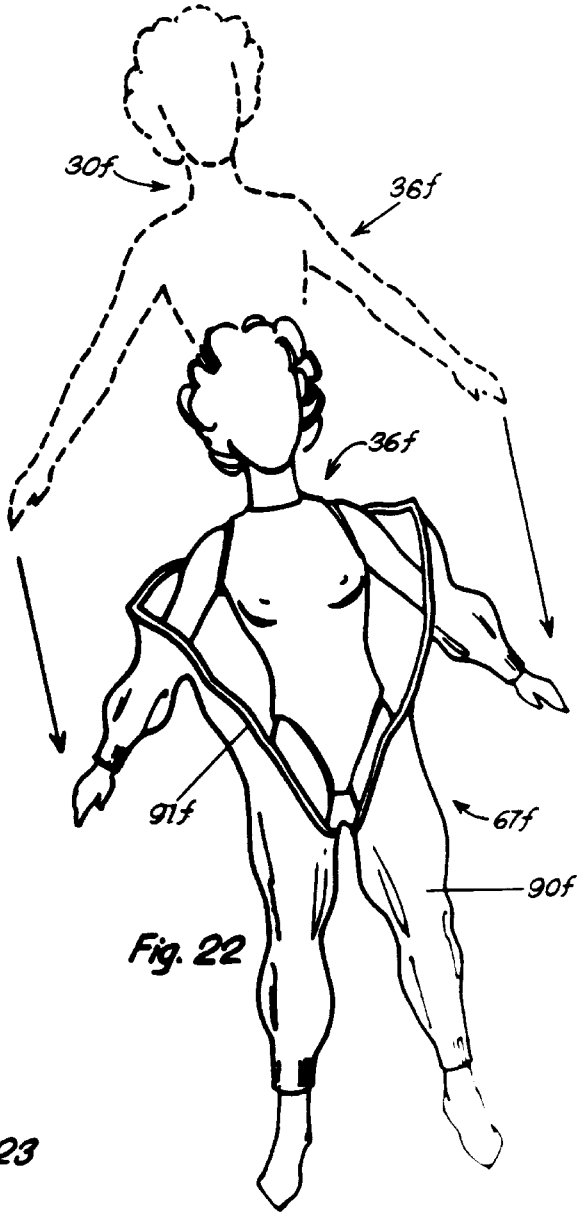
FIG. 22 is a perspective view illustrating schematically the insertion of a preformed doll or toy figure into the interior of the inflatable "suit" of FIGS. 20 and 21.

When the liner is made having only the openings just discussed, the next step is to provide an outer skin layer 90*f* completely covering the inner layer 78*f* and having sufficient seams so as to form, in combination with the inner liner 78*f*, a bladder having the size and shape of the doll or toy body 36*f* with which it is to be associated in use. Referring again to FIG. 21, the most convenient way of forming such an outer layer 91*f* is to use the materials in the manner shown and create seams on the outer skin to make it effectively a single piece, and then to provide air-tight seams at the neck at the margins 182*f*, 184*f*, 186*f* forming the openings respectively for the sleeves, the trouser or leg cuffs, and the neck cuffs area. Insofar as an opening or center seam 91*f* is provided, an inner to outer skin seam is provided in this area also. Referring again to FIG. 21, the outer layer of skin 90*f* is shown just prior to final seaming to surround the inner layer so that in effect a two-ply suit is provided for reception of the doll body 38*f*. FIG. 22 shows the manner of using the combination suit and bladder 67*f*. The body 38*f* of the doll or toy FIG. 30*f* is simply inserted much as a human would enter a ski suit, jumpsuit, or other one piece garment. When the toy or doll body 38*f* has been inserted as shown in the solid line portions of FIG. 22, the center seam 91*f* is formed so as to secure the suit over the body or core. In the preferred construction, inasmuch as the outer skin 90*f* is a rubberized fabric or other elastic outer layer, inflating the suit, once it is positioned on the doll will enable the figure to achieve apparent weight gain or loss as the suit itself is inflated and deflated. All are not shown in detail, inflation/deflation is achieved through the use of a small valve positioned in an inconspicuous location (not shown) of the suit.

As is true with the other embodiments, it is normally preferable that the access flap or placket be placed in the rear of the doll rather than the front, but this is a matter of choice for the user.

Figure 23:
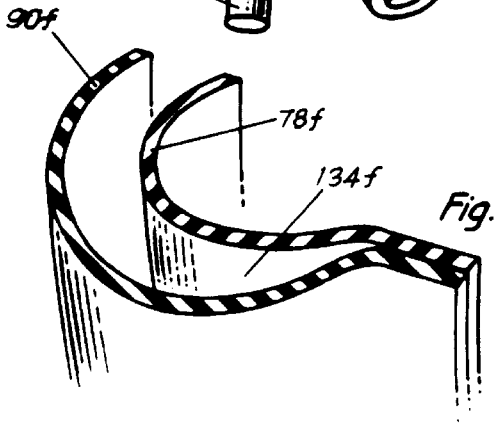
FIG. 23 is an enlarged fragmentary perspective view of the detail of one portion of the body suit shown with the toy or doll of FIG. 22.

Referring to FIG. 23, the provision of an air space 134*f* between the inner liner 78*f* and the outer liner 90*f* is shown, it being understood that FIG. 23 is an illustrative cross section only showing margin seaming and the provision of a space between the inner and outer layers.

While not preferred, it is of course also possible that the "jumpsuit" just described be made from inner and outer layers of non-extensible material, in which case the outer layer would be covered with a further layer of elastic material.

Figure 24:
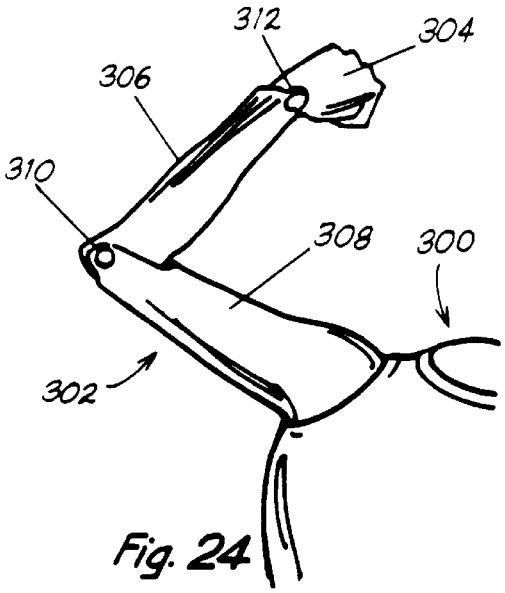
FIGS. 24–28 are perspective views of the arm and shoulder portions of a toy or doll used to simulate change of contour due to "musclebuilding", and showing an expansible bladder, a confinement sleeve or girdle partially covering the bladder, and a life-like elastic exterior skin covering the bladder and sleeve or girdle, and showing how inflation simulates muscle growth.
Figure 25:
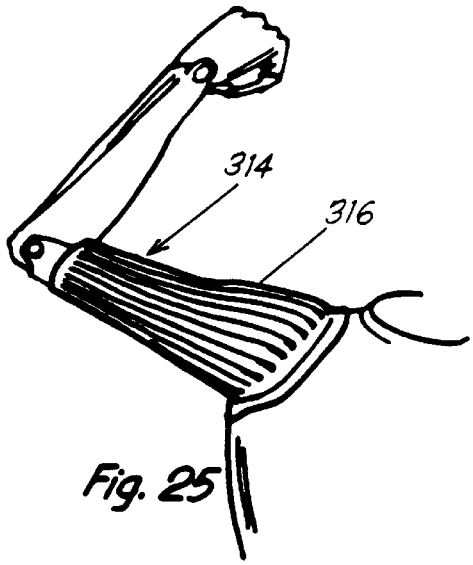

Referring now to FIGS. 24–28, another application of the principles of the invention is shown. Here, it is desired to have a toy or doll that is able to undergo an imagined "muscle building" regimen resulting in enlargement of carefully defined arm and shoulder muscle areas, for example. Thus, FIG. 24 illustrates a doll or toy figure generally designated 300 and shown to include a movably attached arm generally designated 302 and shown to include a hand or fist 304, a forearm 306 and an upper arm 308. Pivot points 310, 312 are illustrated as being provided to permit movement of the hand or fist forearm and upper arm relative to each other. The movable shoulder joint is not illustrated but will be understood to be present and may be made in a manner known to those skilled in the art. FIG. 24, illustrates the core portions wherein at least the upper arm and forearm 308, 306 are made from a substantially non-compressible material such as hard rubber plastic or the like. In keeping with the invention, a bladder generally designated 314 and shown to be of sleeve-like construction is fitted over the upper arm 308. The bladder has inner and outer layers (not shown in detail) similar to those of the bladder shown in FIGS. 8–12. The seaming pattern is arranged in a convenient manner and the slack portions, particularly at the upper and lower portions of the upper arm, are provided.

Figure 26:
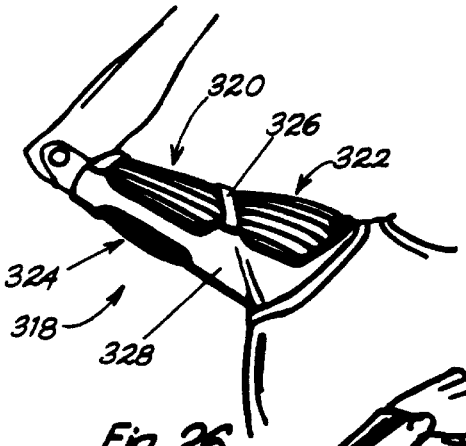
Figure 27:
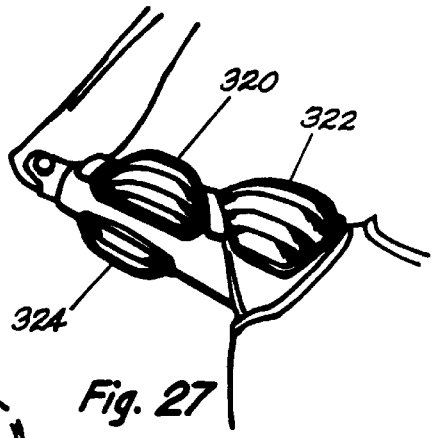

FIG. 26 shows that the bladder 314 having the seamed areas 316 to define individual air pockets is then covered with a girdle arrangement generally designated 318 and shown to include pre-selected areas 320, 322, 324 of minimal or no confinement. In addition, a strap 326, a thin section, is shown helping to define the adjacent open areas, 320, 322. In this embodiment, the portions 328 of the girdle or cuff 318 that are not open are substantially non-expansible. Consequently, when the sleeve or cuff serving as the bladder 314 is inflated, those unconfined areas 320, 322, 324 permit sections of the inflatable bladder, sleeve or cuff to expand to simulate muscles such as shoulder biceps or triceps muscles. An additional touch of realism is provided by covering the bladder and confining cuff or girdle 318 with the skinlike, flesh-colored, expansible fabric or rubber sleeve material 330. Consequently, the expansion contraction mechanism is less visible and a realistic effect is attained. Filling and emptying the bladder may be done as described elsewhere herein, using inflation and deflation as required.

Figure 28:
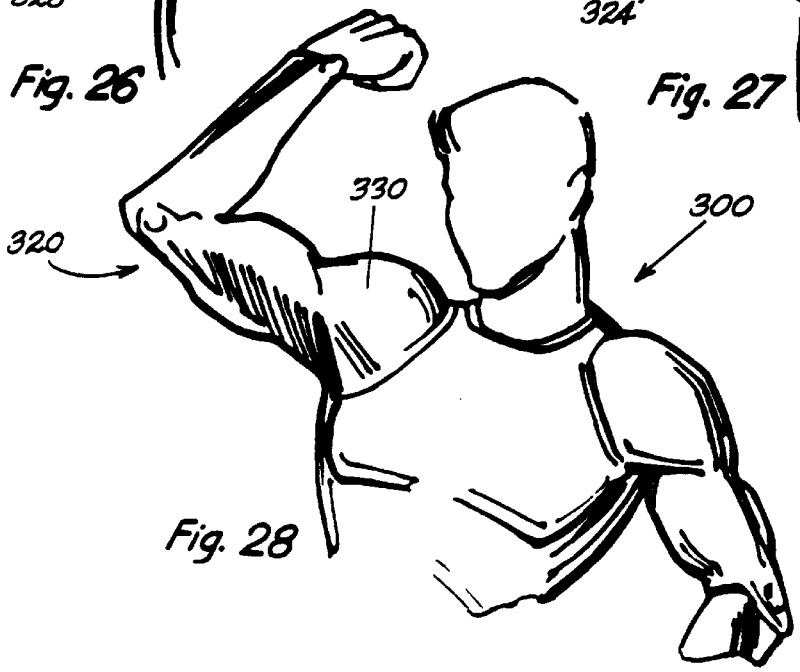

FIG. 28 also shows that the FIG. 300 of the "muscle builder" is capable of having additional bladder and girdle arrangements to permit expansion of the chest, back, leg and other areas wherein as much detail as desired may be provided using the principle of a bladder that is selectively confined by a girdle or the like having patterned areas suitable for creating a "muscle man" or "muscle woman" appearance. These principles may also be applied to simulate other bodily conditions such as pregnancy, maturity or the creation of "beauty contest" female figures or the like.

All of the foregoing descriptions have involved the creation of a separate bladder, or in any case, an expansible air space lying outside the core or body of a toy or doll figure and being defined by inner and outer layers, one being an expansible exterior skin.

FIGS. 29–33 show a further modification or improvement of the types of toys, dolls or mannequins just discussed, but differ therefrom in that no separate impermeable inner layer is provided. Instead, only an exterior skin is provided in addition to the core. In FIGS. 29–32, the entire core is filled with air and the attachment points are sealed to insure the integrity of the core; passages between the interior of the torso, arms, legs or other inflatable areas are provided so that air (or other inflating fluid) can have access to the expansible space.

Figure 29:
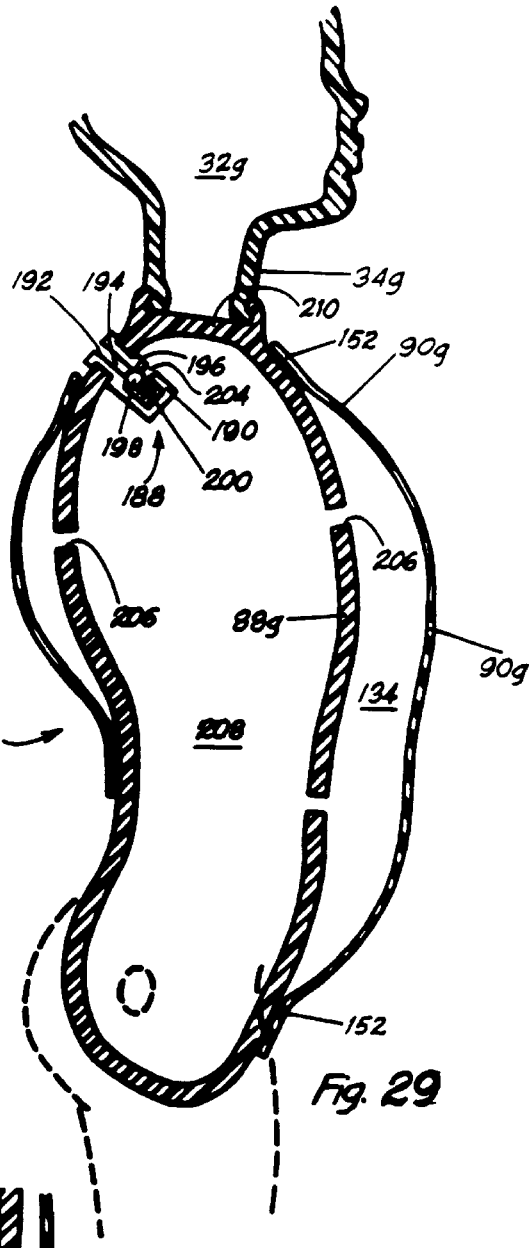
FIG. 29 is a vertical sectional view of the toy or doll of another embodiment of the invention, taken along lines 29—29 of FIG. 33.

FIG. 29 shows a form of toy or doll body wherein the torso only is inflatable and wherein only certain portions of the torso are covered by an expansible exterior skin which might be considered analogous to a vest having a front area of attachment well below the waist and back area of attachment at or above the waist; in any case, a lower margin extends about the entire lower body and upper margin about the neck and other margins about the arm and neck attachment areas.

Figure 32:
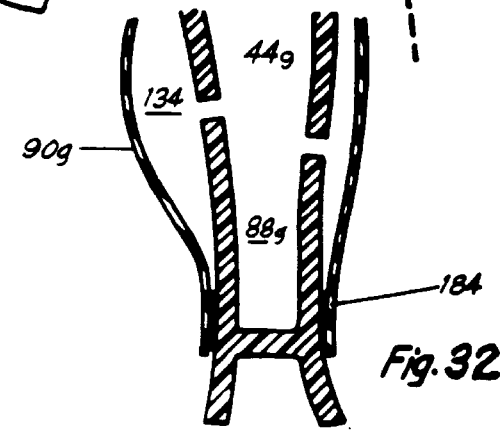
FIG. 32 is a vertical sectional view, taken along lines 32—32 of FIG. 33 an showing the construction of a leg portion of the doll of FIG. 33.

Referring now to FIG. 29, therefore, there is shown an expansible air space 134 defined between the walls 88*g* of the torso 36*g*. In the construction of FIG. 29, a doll head 32*g* and neck portion 34*g* are attached to the body or torso 36 forming a part of the body. An exterior expansible skin 90*g* is placed over most portions of the outer wall 88 of the torso 36, being affixed, for example, at upper and lower margins 152 surrounding respectively the neck and shoulder areas at the top and the lower waist portion below. As shown in FIG. 32, the core or torso 36*g* includes, near its upper end or elsewhere in a convenient location, a ball-type check valve generally designated 188. This unit 188 includes a valve body 190, a cylindrical wall 192 defining an inlet passage 194, a tapered, ball-receiving seat 196 which, in the closed position of the valve, accommodates with a sealing and centering action a ball 198, preferably made from a rubber material. The ball is urged to the closed position by a coil or like spring 200 having one end engaging the ball and the other resting on a spring seat. An outlet passage 204 is also provided in the valve body 190. Such ball-type check valve being generally known to those skilled in the art, the description of additional constructional details are omitted for simplicity. As pointed out, any suitable means of inserting and retaining the valve 188 in such a way that it will pass through a wall 88*g* of the doll torso 36*g* may be used.

According to this form of the invention, the torso itself must be substantially air-tight, and consequently a neck seal 210 in the form of a blind passage is provided for this purpose; the plurality of passages 206 are provided to permit air to flow in both directions from what will become a pressurized core 208 of the torso 36*g* into the expansible space 134 lying between the outer surface of the wall 88*g* and the outer skin 90*g*. In the form of product shown in FIG. 36, it is assumed that no provision is made for apparent weight gain in the legs or arms, but that the connection of these limbs to the torso is the same as that provided before the neck, i.e., the torso as a whole is of an air-tight construction. The ball-type check valve in use operates in a conventional manner and the attachment fitting for it and an associated pump may be of a screw-on type, a press over type, or other convenient form of connection. With a ball check valve, a simple rod or pin is all that is required to unseat the ball for deflating the core and hence, the inflatable space 134.

FIGS. 30–33 show the concept of FIG. 29 applied to an embodiment wherein additional portions of the core, although including parts that are movable with respect to each other, forms a single, inflated entity that is closed off only at the attachment areas for the feet, neck, and arms or hands. As long as the exterior skin is air tight and is seamed at these areas, the entire bladder will expand and contract as a unit under the influence of air pressure supplied to the core from any source, including an external source such as the pump shown in FIG. 15.

Figure 30:
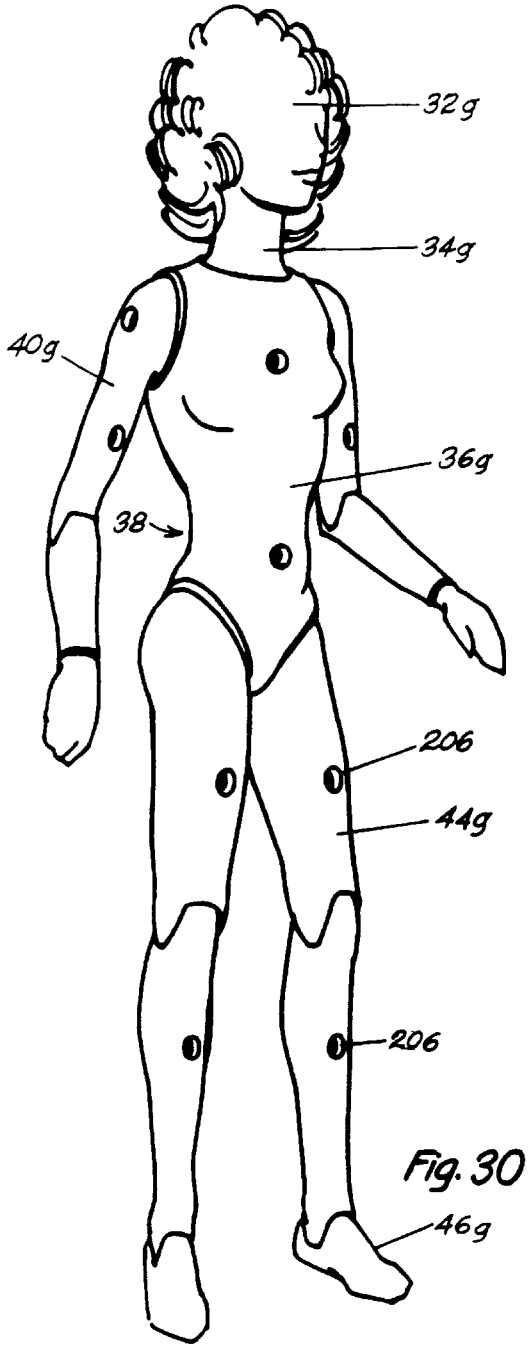
FIG. 30 is a perspective of the core of a doll made according to the invention and before covering the core with an elastic outer skin.

Referring in particular to FIG. 30, the core is shown to be a multi-piece unit, including a body generally designated 38 with a torso 36*g*, arms 40*g*, legs 44*g* and feet 46*g*. Each of the arms and legs has a hollow section containing one or more apertures 206. In the illustrated embodiment, the neck 34*g* and head 32*g* are constructed and arranged so that there is an air tight seal between one or both of them and the body 36*g*.

Figure 31:
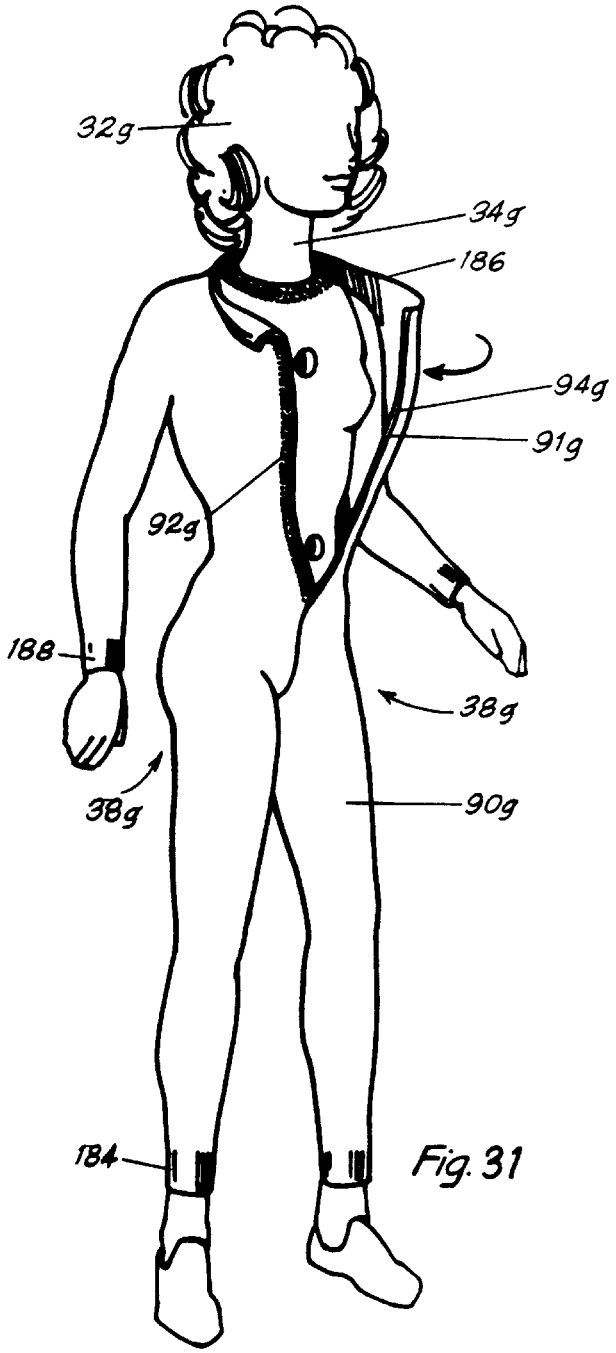
FIG. 31 is a view of the doll core of FIG. 30 covered with an expansible skin.

FIG. 31 shows the addition of a single ply, skin-simulating outer layer 90*g* to the body 38*g*. In the form shown in FIG. 31, the legs are shown as being of a single piece, although it will be understood that one or more air tight seams may be present in their construction. A center seam 91*g* is shown to be made from opposed surfaces 92*g*, 94*g* which, when overlapped and seamed along the stippled areas shown in FIG. 31, will make a unitary, air tight exterior bladder surface 90*g*. A neck area 186 is shown to be stippled to indicate that an attachment is being made there. Areas such as the cuff areas 184, 188 are also to be seamed in air tight relation with the core.

Referring to FIG. 32, a pant or leg cuff seam 184 is shown where the lower margin of the suit leg surrounds the leg portion 44*g* of the core. The outer skin 90*g* is shown in a fully inflated condition, creating an air space 134 between the outer surface of the wall 88*g* and the skin 90*g*. As long as these surfaces remain air tight and plugs or the like are provided for the limb ends, the expansion of the outer skin 90*g* will be generalized in relation to pressure and the extent to which it is pre-stressed, its thickness, or other consideration may dictate its finally inflated form. However, in keeping with general principles, if the main body section is larger in area, as it customarily is, the total amount of expansive force will be greater and expansion will be more visible, thus closely replicating the case of a human undergoing undesirable weight gain.

Figure 33:
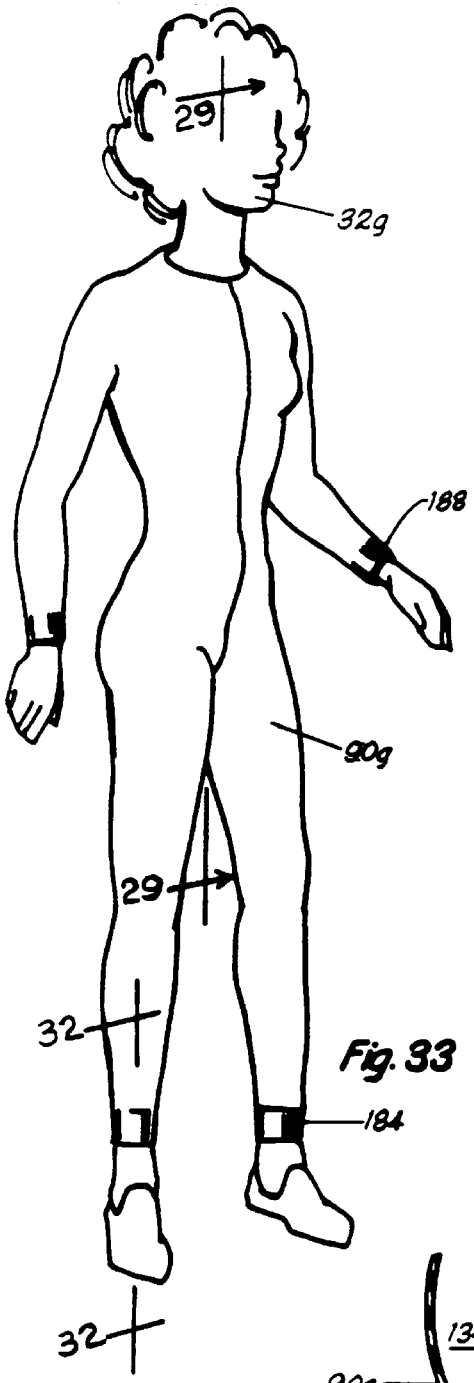
FIG. 33 is a perspective view of the doll of FIGS. 30 and 31, showing the exterior skin in a final position of use.

FIG. 33 is an illustration similar to FIG. 31, but showing the outer skin 90*g* fully closed and sealed relative to the underlying inflatable core or the like. As pointed out, the inflation of the core may be achieved by a valve arrangements of the type just described or of the type described elsewhere herein.

In the above illustrations, at least the skin and in the case of multi-layer bladders and skins, all of the parts necessary to form the bladder were made separately and then affixed or attached to the toy or doll figure. In other words, the material was made from a previously shaped sheet or film, whether of fabric, plastic, rubber or the like.

FIGS. 34–36 show a simplified method of making an expansible skin from a liquid material. Here, referring to FIG. 34, a torso generally designated 400 is shown to be provided and to have a main body section 402 and attachment areas 404, 406, 408 for the neck, arms, and legs, respectively. The exterior surfaces are imperforate except for a plurality of spaced apart openings 410, shown in broken lines. The body 400 is of a hollow construction and may be made from a suitable, comparatively rigid material and is formed with the openings shown. The size and location of these openings may be chosen by the manufacturer.

FIG. 35 shows that the body 400 has been treated to provide certain patterned areas including a patterned area 412 about the neck attachment patterned areas 414 forming annular areas 416 about the leg attachment area. Here the stippled pattern illustrates that, after manufacture of the body, the areas are coated with a material which is strongly adhesive to or reactive with a curable latex material. FIG. 35 also shows that a spray gun generally designated 418 is applying through a fine mist or spray 420 a liquid release coating shown in broken lines to cover the area 422 of the body 400 not covered by the adhesive patterned areas. Inasmuch as the openings 410 lead into the interior of the hollow or open interior of the body 400, these areas are covered by patches 424 of a loosely applied seal such as a masking tape or the like sufficient to position the liquid impermeable patches and form a liquid-tight but releasable seal with the patch material which may be a silicone impregnated paper or the like such as masking tape. After the patterned areas for adhesion and release have been selected coated by the spray, which might typically be a silicone mold release agent of the type known to those skilled in the art of rubber or latex forming and molding, the body 400 is then covered with a layer of a curable elastomeric material such as a latex. FIG. 36 illustrates that this may be done by dipping the figure into a bath 424 of liquid received in an open container 46 and removing the body. In such a case, after this step is performed, the natural cohesion of the latex or other curable liquid is such that it will form a film, having certain areas strongly adherent to the core or body 400 and other areas which will not bond or be affixed to the remainder of the surface. After the latex or other curable elastomeric material has been cured, an inflatable area 428 which is that shown in FIG. 36*b*, will be provided between the outer surface 402 of the body and the inner surface of the latex layer 430 (FIG. 36*b*). After this curing and adhesion/release action has taken place, as illustrated in FIG. 36*a*, then pressure from the interior 432 will be present in the passage 410 and act outwardly on the tape or like patch 424, sufficient to dislodge it and permit creation of the expansible space 428. Here, it is assumed that the valve or other inflating means is provided for the space 432 inside the body 400.

Figure 37:
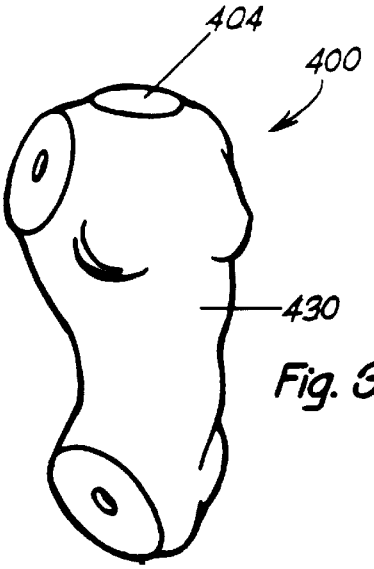
FIGS. 37 and 38 are perspective views of toy or doll body torsos having air impermeable, expansible exterior skin and showing the torso in its respectively reduced and enlarged contour size.
Figure 38:
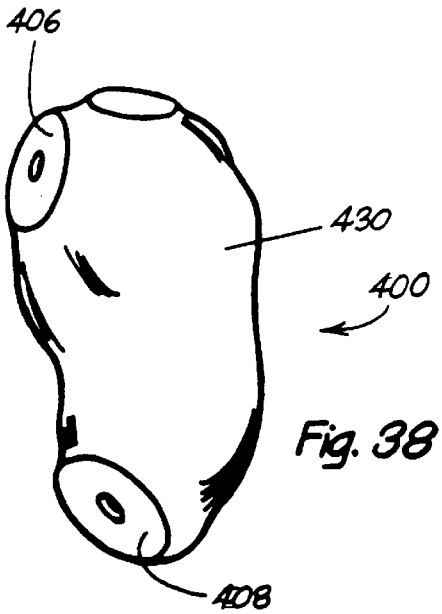
Figure 39:
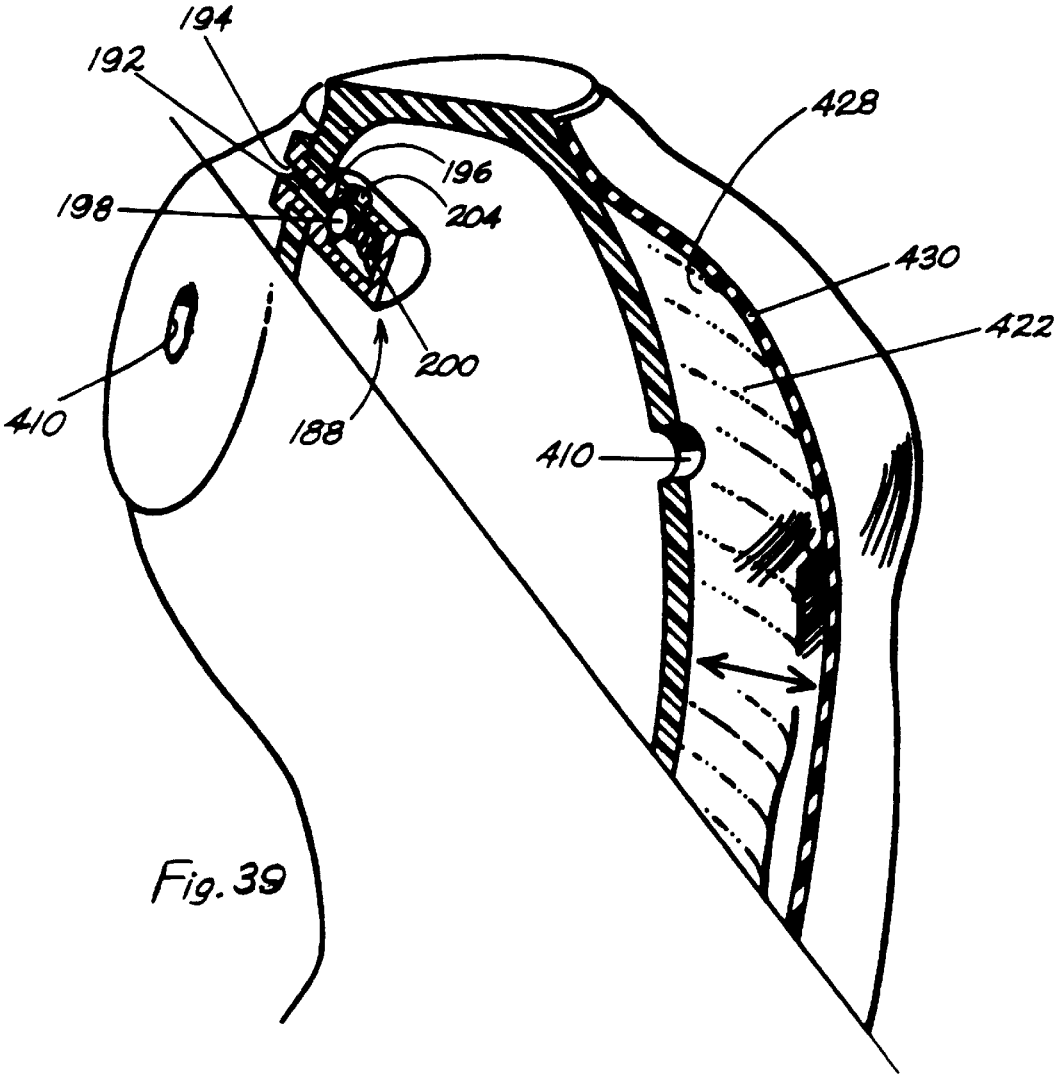
FIG. 39 is a fragmentary perspective view showing certain portions of the torso of FIG. 37 on an enlarged scale.

Referring now to FIGS. 37–39, the positioning of a typical valve and the inflation of the air space 428 just described is shown. FIG. 37 shows a completed body having a latex exterior skin in the unexpanded condition and FIG. 38 shows the same only with a significantly enlarged outer skin. With a properly created latex, a very lifelike condition can be created. FIG. 39 shows the positioning of a ball check valve very similar to that of FIG. 29, located in the area of the back just beneath the neck, and shows the potential for expansion of the outer skin layer 430.

Figure 40:
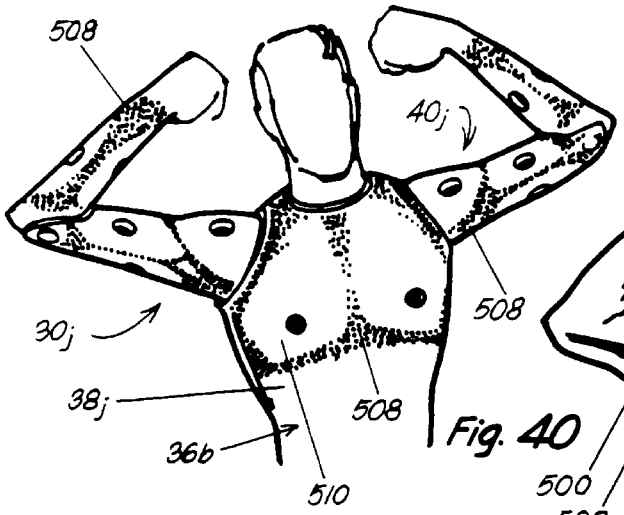
FIG. 40 is a perspective view showing the core or base portion of a toy figure with adhesive and release areas arranged in a predetermined pattern so as to enable an exterior, elastic skin to cover the torso and to be expansible only in predetermined areas.
Figure 41:
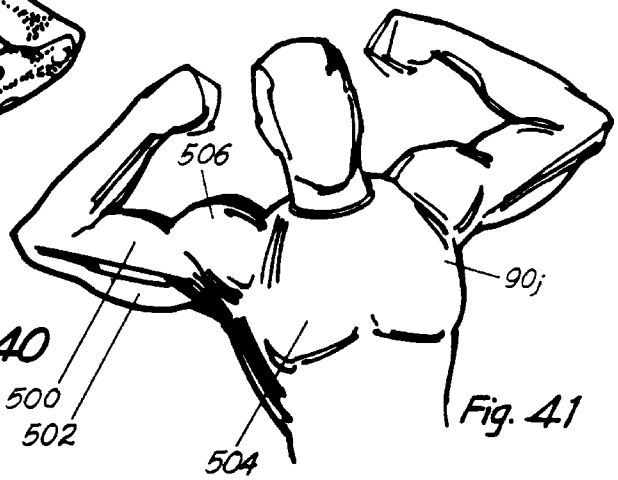
FIG. 41 is a perspective view of the toy figure shown in FIG. 40 with its exterior skin and inflated to simulate a male bodybuilder with bulging muscles.

Referring now to FIGS. 40–43, a further application of the principles of FIGS. 34–36*b* are shown. Here, such as in FIGS. 30–41, there are illustrated a method of making a doll or toy body 30*j* having a doll generally designated 30*j* having a body 38*j* with a torso 36*b* and left and right hand arms 40*j*. In this construction, the object is to create a plurality of individually inflated chambers 500, 502, 504, 506, each corresponding to a muscle which is intended to undergo growth or expansion and each of which is defined by a peripheral area of adhesion 508 (FIG. 40). In other words, where a layer of adhesive material is affixed to the body 38*j* or the arms 40*j* in a desired pattern, will be separated from the defined, adhesive coated areas 508. Provided that each of the separate chambers 500, 502, has an access opening to the pressurized center core, expansion will take place upon pressurizing of the core. FIG. 41 shows such a result, with the "muscles" in the areas 502, 504, 506, etc. bulging outwardly in the non-adhesive areas and with the outer "skin" coating 90*j* being affixed to the core in the adhesion areas wherein no expansion is permitted. Accordingly, the principle of patterned adhesion free, expansible areas bordered by non-expansible, adhered areas is provided by using this concept. In this connection, the application of the adhesive and/or the release may be done in any desired matter, including stenciling, brushing, rolling or the like. Likewise, the application of the adhesive material itself may be achieved by placing a reinforced, expansible fabric over the areas or by dipping, brushing, or spraying the entire body once it has been treated with adhesive and/or release coating materials in the desired pattern. In this connection, it will be understood that the surface of the substrate or core material may be such that it is naturally adhesive or non-adherent to the covering material. In such cases, one of the core covering or treatment materials may be omitted.

Figure 42:
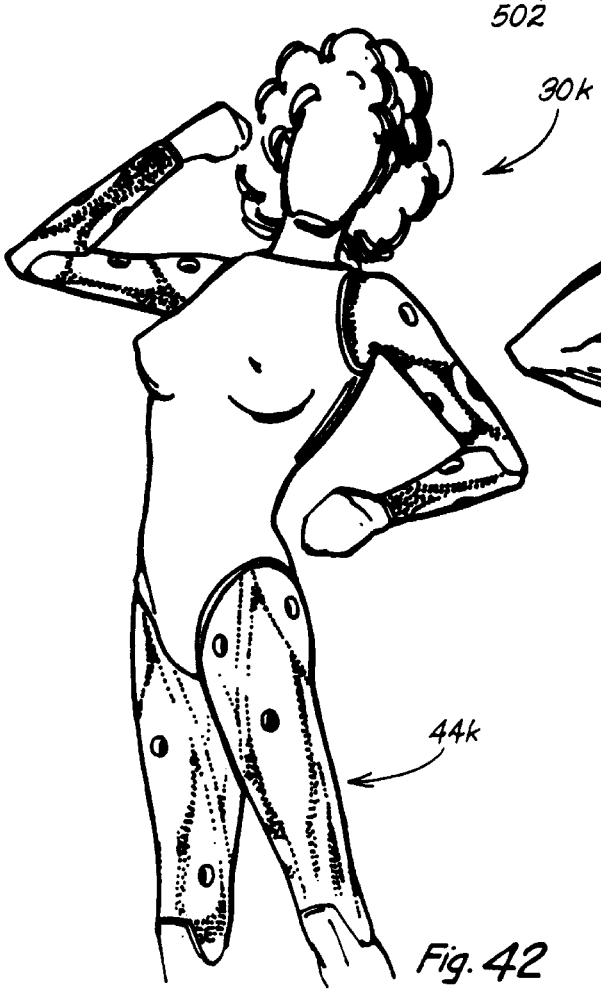
FIGS. 42 and 43 are perspective views showing the attachment of an expansible, exterior air-impermeable skin to a female toy figure.
Figure 43:
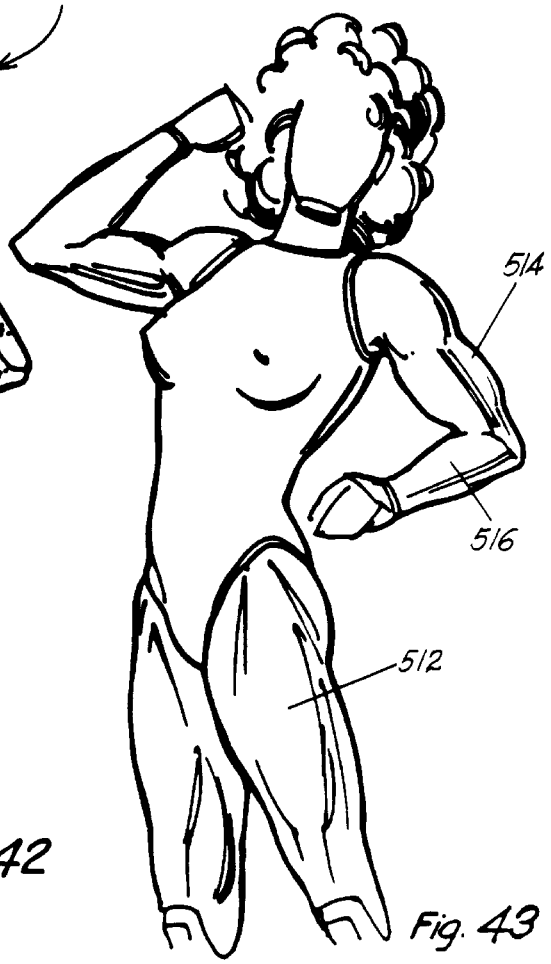

An alternate method comprises the use of a replica surface. Here, the replica surface is used to make a covering or skin from the elastic material, such as a rubber latex. After the replica is covered and the film cures, the skin is removed from the replica surface and affixed over the core by the use of a patterned adhesive. The adhesive may be of the contact type but is preferably curable, as by heat or catalycis. FIGS. 42 and 43 show a female toy or doll figure generally designated 30*k* and shown to have counterpart muscle building areas lying primarily in the arms and legs. Thus, the legs 44*k* of the doll of FIG. 42 show adhesion patterns running generally lengthwise to define vertically elongated muscle expansion areas seen as thigh muscles 512 in FIG. 43. The arm muscles such as those 514, 516 may be similar to their counterparts 500, 502 in FIG. 41. In the case of FIGS. 42 and 43, no torso expansion is provided for, although it is within the inventive concept to permit limited or even larger scale expansion in these areas. As long as each of the individual chambers sought to be made includes a vent hole for pressurization and release, the inventive concept may provide for "muscle growth" in the areas of non-adhesion. As with the other embodiments, if the skin is not itself life-like, a skin-like covering may be placed over the outer bladder surface; a knit or woven fabric might be suitable for this purpose.

Figure 44:
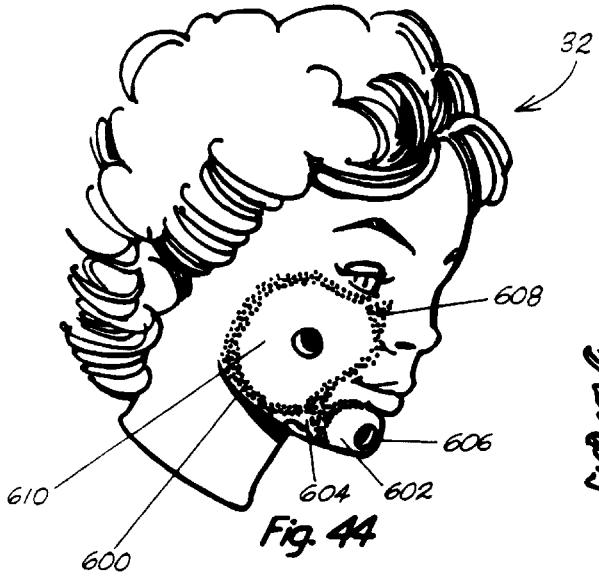
FIGS. 44 and 45 show applications of the selective adhesion/release technology of FIGS. 40–43 to the face portion of a toy or doll figure.
Figure 45:
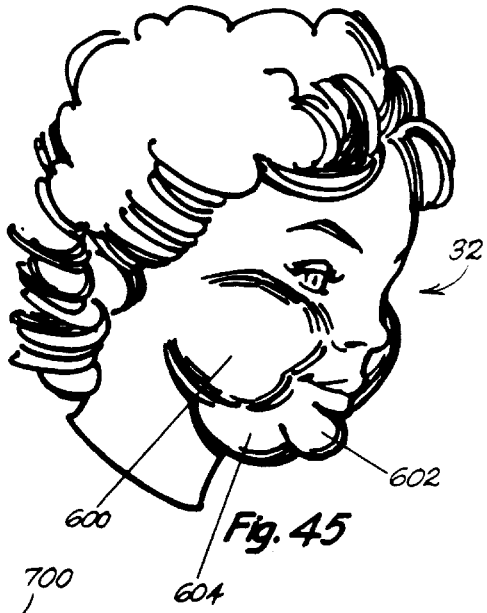

Referring now to FIGS. 44 and 45, the principles shown in FIGS. 34–43 are applied to a face having an expansible cheek, chin and jowl areas 600, 602, 604. Each of these is provided with an inflation passage or port 606, for example. Here, the pattern of an adhesive material 608 is applied to define the margins of an expansible area. If the surface of the substrate or core material, in this the material comprising the head generally designated 32 is adherent to the covering material, a release coating is applied to the area 610 lying inside the adhesive margin 608.

As shown in FIG. 45, after such material has been applied and cured, inflation of the interior of the head 32 will create a bulging of the cheek, chin and jowl areas 600, 602, 604. Such provision of expansible areas in the facial regions of the toy or doll may carry out the illusion of weight gain in a very realistic way, and this feature may therefore be provided in a high cost, more complex but correspondingly realistic toy figure.

In describing control of skin expansion in connection with an earlier embodiment, reference has been made to applying a girdle or collar arrangement to an expansible bladder, or adhering certain sections of the skin to the substrate by adhesive or the like. Other forms of expansion control are also possible. In this connection, reference is made to FIGS. 46–48 wherein an illustration is made of a composite fabric section generally designated 700 and shown to include a top cloth layer 702 having an inner margin 704 defining a central opening 706 therein. The lower layer 708 of cloth forms the second half of the composite cloth or skin 700. When the two elements 702, 708 are placed together as shown in FIG. 47, a sheet is formed that has an unsupported center section 710 made exclusively from the material of the lower layer 708, while the remainder of the cloth or fabric is of a double weight or two layer construction. Consequently, as shown in FIG. 48, if an expansion force is applied to the undersurface of the composite materials 700, a bulge 712 will appear where the elastomeric, unsupported under layer made from the material 708 will extend through the opening 706 in the upper layer 702. Consequently, a controlled expansion may be achieved by providing plural layers, with one of the layers including confined and unconfined areas permitting a single ply area to expand to a greater degree than a multi-ply area.

Figure 46:
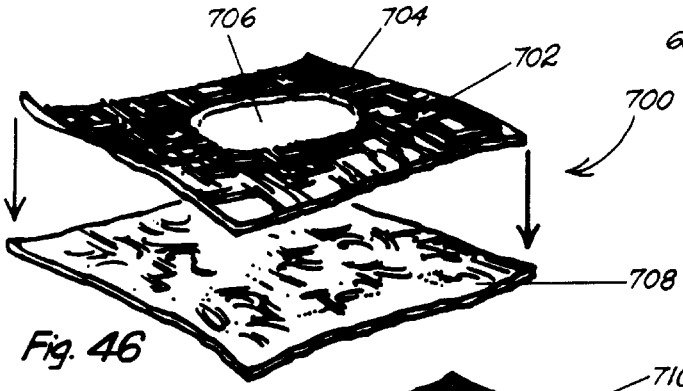
FIGS. 46–48 illustrate a different method of controlling elastic skin expansion utilizing elastic exterior cloth having sections with varying resistance to expansion.
Figure 47:
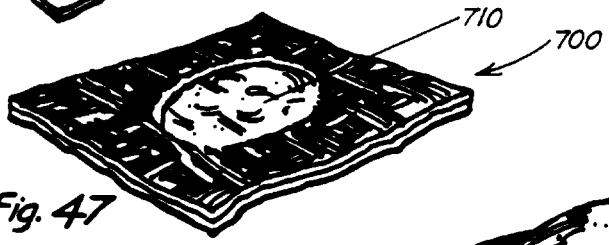
Figure 48:
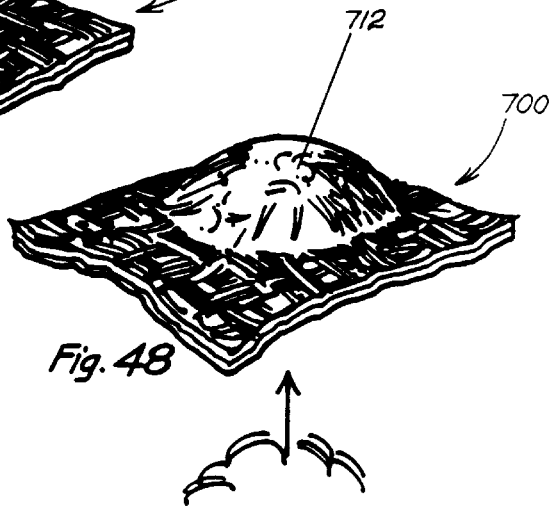

In the embodiment shown in FIGS. 46–48, the less expansion resistant material is shown as being the one closest to the pressure source whereby it expands through the confining outer layer; however, if the two are adhered together throughout a substantial portion of their extent, the same effect can be achieved even if the more highly expansible layer overlies the less expansible one. In this connection, the relative resistance to expansion of the two layers may be the same or either may be more confining than the other, the principle being merely that the multi layer sections will possess greater expansion resistance.

These principles may be applied with or without the use of single or double layered bladders. Likewise, the similar control may be achieved by weaving or knitting a single fabric sheet having a higher thread count in the more confined areas than a reduced thread or weave count in the areas less resistant to expansion.

In certain of the foregoing examples, the adhesive and release coatings respectively work applied to the toy or doll that was to be covered with the liquid that was to be applied dipping, spraying, brushing, etc. An alternative method can comprise providing a core product, whether a head, face, body or body part that is itself non-adherent to the film forming latex or other elastomeric material to be applied to it. After the film forming material has been applied and has been permitted to cure, it may then be removed as a self-sustaining skin. Thereafter, the doll or toy product with adhesive attached thereto in certain areas only may be covered by the elastomeric skin material and the adhesive permitted to cure or react with the covering. Particularly where the surface to be covered is of a suitable shape, this method might be preferred. Thus, in regard to these faces shown in FIGS. 44 and 45, the skin could be preformed over a dummy face which is identical to that shown in FIG. 44, but without the adhesive areas thereon. Thereafter, a mask of cured film forming material removed from the core could be placed over a figure having the adhesion areas shown in FIGS. 44 and the adhesive permitted to cure to secure the loci of attachment. A similar result could thus be obtained.

Referring to additional embodiments of the invention, FIGS. 49–51 show the use of the toy or doll with a pair of accessory units, one being an inflating pump and the other a toy or simulated scale. This embodiment of the invention shows the use of accessories in connection with the product to achieve a heightened sense of realism.

Referring now to FIG. 49, there is shown the figure of a doll generally designated 30*x*, having a head 32*x* and body 38*x* of the type referred to above and containing an expansible exterior skin 90*x* shown in phantom lines to indicate enlargement. The doll 30*x* is in position over the platform 800 of a simulated scale 802. The scale includes, in addition to the platform 802*a* a vertical section 804 terminating in an upper housing 806 that includes a face 808 wherein a pointer 810 indicates apparent weight on the gradations of a scale 812.

FIGS. 49–51 show certain constructional details of the scale which include an inflation inlet tube 814, a pressure transfer tube 816, and a mechanism generally designated 818 for indicating simulated scale weight. This mechanism 818 includes the top housing 806, the connecting tube 816, a right angle fitting 820 and a body 822 having an interior cylindrical surface 824 accommodating a reciprocable piston 826. The pointer rod 810 has its inner end 828 affixed to or integrally formed with the piston 826, whereby reciprocation of the piston 826 within the cylinder moves the end portion 830 of the pointer 810 opposite an appropriate gradation on the scale 812.

An inflatable chamber 832 is formed between the cylindrical walls of the body 822, the end face of the piston 826 and the ported end wall 834 of the body 822. From FIG. 50, it is apparent that whatever air pressure is present in the tube or line 816 will appear within the chamber 832, and an increase in that pressure will bias the pointer 810 to the right as shown in FIG. 50. A compression spring 836 biases the piston the left or towards a zero or low rate reading, while an increase in pressure in the area 832 will bias the piston 826 and the pointer carried thereby to the right, with the pointer tip 830 reaching an ultimate position of equilibrium dictated by the pressure present in the line 816.

Referring now to FIG. 51, it will be seen that the pressure in the interior 208 of the doll body is the same as that within the expansible space 134 owing to communication between these regions through the leg port 220. A pump 840 having a duck bill type inlet valve 842, a duck bill or reed outlet valve 844 and a nose portion 846 adapted to register with the inlet tube 814 provides pressure to the interior 848 of the scale base. An additional, anti-bleed-down reed valve 850 is provided in the scale base in series with the inlet tube 814. The scale platform 800 includes a hollow positioning peg 852 having a center passage 854 extending therethrough and through an extension tube 856 which is positioned within the peg 852. The outer surface 858 of the peg registers with the inwardly directed cylindrical positioning surface 860 of the foot. The leg portion 44*x* of the doll further includes a pressure retention reed or duck bill valve 862 which is engaged and held open by the end portion of the tube 856.

Operation of the accessory "weight scale" and the doll 30*x* will now be described. Assuming that it is desired to have the doll 30*x* undergo the appearance of weight gain, the toy or doll 30*x* is positioned with the foot recess 858. The recess and the positioning peg 858 are sized relative to each other so that a snug but removable fit resulting in a steady positioning of the doll body is provided. When the foot 46*x* of the doll rests on the platform 800 of the scale 802, the valve 856 is biased open. Manipulating the pump 840 causes air to flow through the scale body duck bill valve 850 through the foot valve 862 into the interior 208 into the doll body 30*x*. At the same time, inflationary air is passing through the tube 816 and into the chamber 832 of the scale indicator mechanism. As additional air pressure appears within the doll core, the exterior skin 90*x* expands and takes on an increasingly larger contour. This increase in pressure is also identically "seen" by the chamber 832, with the result that increased size of the doll resulting from increased inflation pressure creates an increase in apparent weight as indicated by the scale pointer 810.

When the pump 840 is removable, the duck bill valve 850 closes, but as long as the doll remains on the scale, the weight will remain at a fixed level appropriate to the doll contour inasmuch as the closed position of the valve 850 does not permit the pressure in the chamber 832 to be lowered. Thus, the pump may be removed and equal pressure will be present in the doll body interior and in the scale weight indicating mechanism.

When it is time to remove the doll, an upward movement on the body 30*x* releases the foot recess from the support and positioning peg 852. This vertical removal permits the duck bill or reed valve 862 to close, leaving air within the interior of the doll body. However, with the doll having been removed from the scale, and the upper end 856 of the tube is no longer sealed. Thus, air may bleed from the chamber 832 through the line 816 and out the tube end 856, permitting the biasing spring 836 to return the scale weight indicator or pointer to zero.

If it is desired to release pressure from the doll and demonstrate an apparent weight loss, this is done by removing the pump and inserting a tool 166 such as that shown in FIG. 16 to open the valve 850. Air release in this manner is accompanied by an equal loss of pressure in both the doll body interior and the chamber 832. Consequently, the weight scale will indicate a weight condition consistent with that of the doll body contour throughout a wide range.

The foregoing is merely illustrative of many examples of suitable accessory products having means establishing communication between the doll interior air pressure and a characteristic of the accessory. The simulated weight gain and counterpart indication thereof on a scale is considered to be very attractive novel feature readily made possible with the invention.

Figure 54:
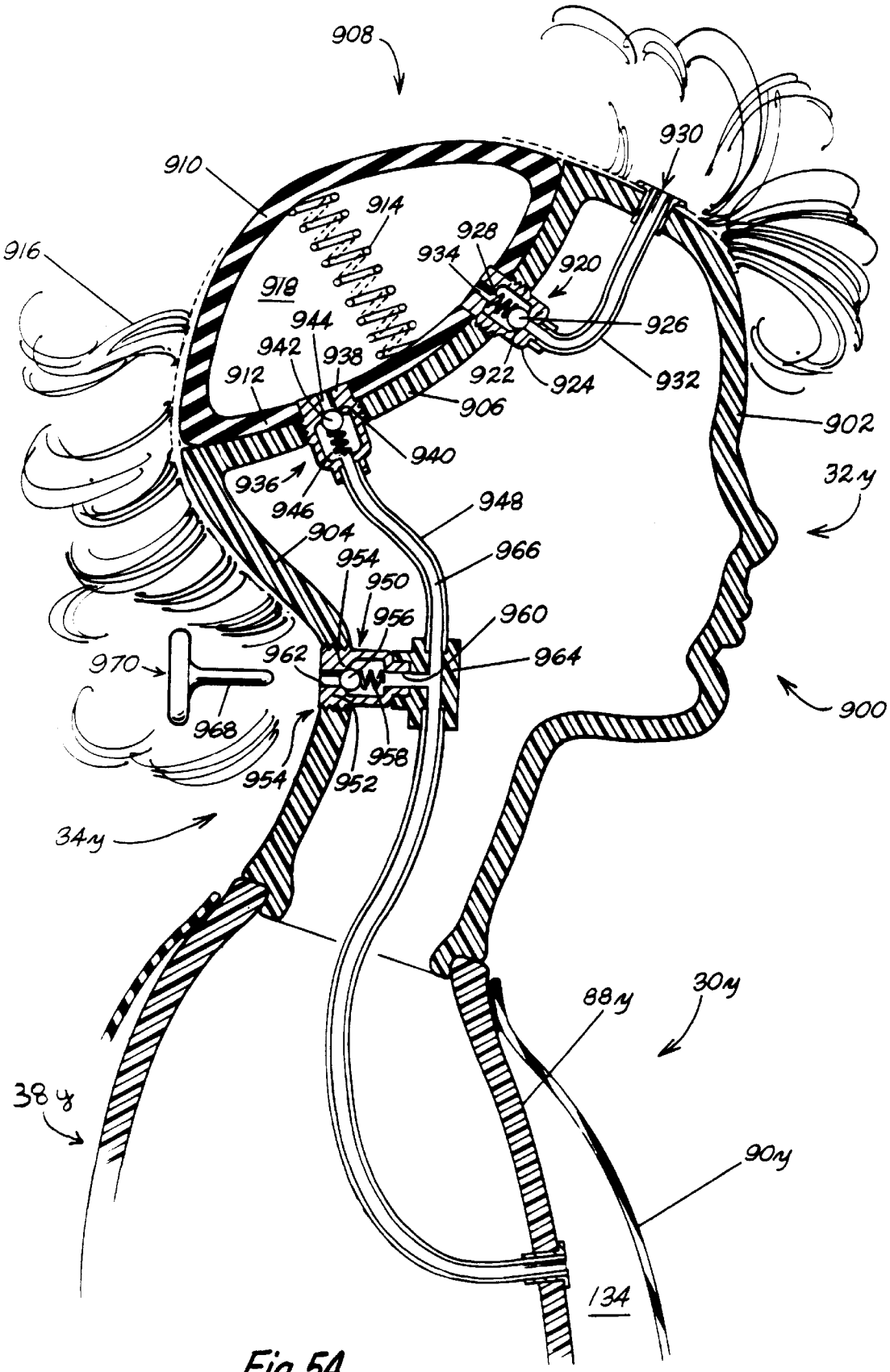
FIG. 54 is a vertical sectional view of a toy or doll containing a built-in inflation pump.

Referring now to FIG. 54, another version of the doll 30*y* is shown. This form of doll contains a built-in air pump for supplying air to the area between the body wall 88*y* and the exterior skin 90*y*. The torso and bladder arrangement generally may be that shown in FIG. 54 or may be any of the other forms previously shown, the novelty of the embodiment shown in FIG. 54 being the built-in pump and valving arrangement.

Referring now to the head 32*y*, according to the inventive concept, a shell generally designated 900 is provided and shown to include a front face or masked portion 902, a rear portion 904 and a cup shaped divider wall 906. The divider wall is surmounted by a complimentary inflation pump bladder generally designated 908 and shown to include an outer wall 910 and an inner wall 912 affixed to and lying generally parallel to the head wall 906. The pump unit 908 is made from an elastomeric material and is naturally biased to the position shown in FIG. 54; however, its innate resiliency may be supplemented by a return spring 914 extending between opposed portions of the walls 910, 912. According to the preferred form of invention, the transition between the various exterior head surfaces is disguised by the provision of a wig 916 closely overlying the head and serving to secure artificial hair in place. According to the invention, air is drawn into the cavity 918 and expelled therefrom by periodically depressing and permitting the return of the exterior surface 910. For this purpose, an inlet valve assembly generally designated 920 is shown to be provided. This valve is a ball-type check valve including a body 922 having means forming a seat 924 for receiving a check ball 926. A spring 928 biases the ball through the seated position and this valve 920 is normally closed. When there is a low pressure or vacuum area within the chamber 918, atmospheric exterior pressure may act on and unseat the ball 926. This permits air to pass through the passage 930 defined by a fitting in the outer skull wall 902, through the inlet tube 932 associated therewith and into the valve outlet passage 934 leading into the closed chamber 918. The inlet passage 930 is concealed by the hair forming a part of the wig 916.

Compressing the exterior domed or rounded wall 910 raises the pressure within the chamber 918 and exhaust air flow then takes place through the exhaust generally designated 936. This unit is shown to include a body 938 having a seat 940 for the check ball 942 sealing off the passage 944 for outlet air. When the biasing spring 946 is overcome by the upstream pressure on the valve, the ball will unseat and permit flow of air through the tube 948 through the remainder of the tube and into the interior air space 134. Consequently, alternately pressing and releasing the top wall 910 of the doll head will serve to take air from the outside atmosphere into the chamber 918 and expel it therefrom, forcing it through the tube or line 948 and into the interior of the inflatable space between the skin 90*y* and the body wall 88*y*. Continued operation will cause a gradual increase in the inflated air space as described in connection with the other embodiments of the invention.

Inasmuch as it is desired to permit the doll, toy or mannequin to "lose weight" when desired, a means is provided for this purpose. Here, a pressure relief valve generally designated 950 is shown to be provided and to have one end of its body 952 secured within an opening 954 in the upper part of the neck 34*y*. This valve body 952 includes a seat area 954 on which the check ball 956 normally rests, being urged to this position by the spring 958. The air may pass through the inlet passage 960 of this valve and into the outlet 962 when the ball is unseated. Communication between the interior 966 of the line 948 and the valve passage 960 is achieved by a "T-fitting" 964. This fitting is a three way connection provided so that when the shank 968 of the pressure relief tool 970 is inserted in the passage 962, air may bleed from the space 134 of the neck passage permitting the doll to be deflated and reach a smaller size.

The concept of a self-inflating doll operative by the principle of having a compressible inflation bladder located in the head is illustrated in FIG. 54. It is also understood that, particularly using a rubber bulb-type pump, it is easy to provide a pump in any other section of the body. The head has been selected as providing ready access to the interior of the torso and to allow a fairly large capacity bulb to be provided without detracting from the appearance of the toy or doll. However, a compressible arm or leg section might serve the same purpose.

The use of a syringe or other type pump, including rotary pumps, pistons or vein pumps or other suitable devices, including electromechanically operated pumps may be used in keeping with the invention. Likewise, pressure sources such as regulated or unregulated small compressed gas cylinders may be used.

Figure 52:
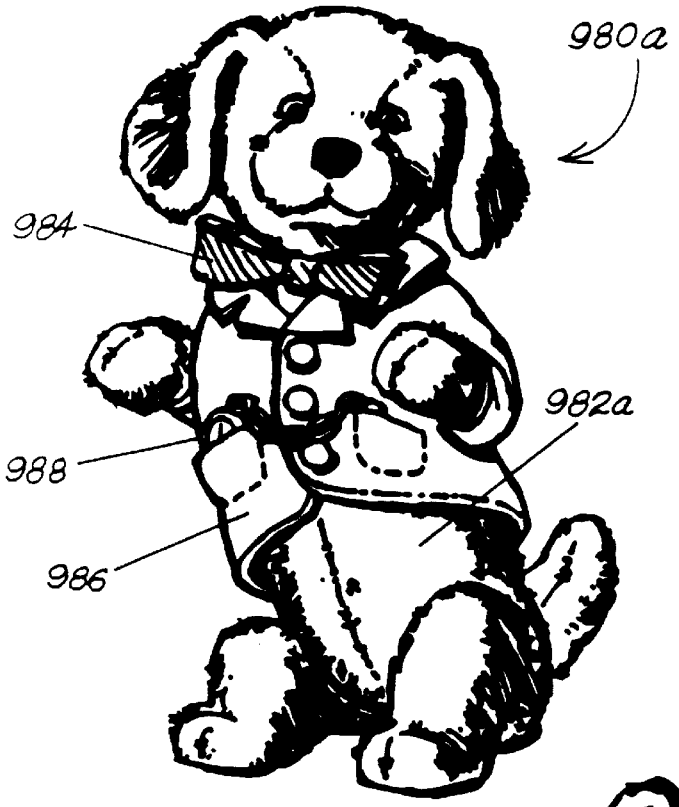
FIGS. 52 and 53 are perspective view showing the application of the inventive principles to toy animal figures.
Figure 53:
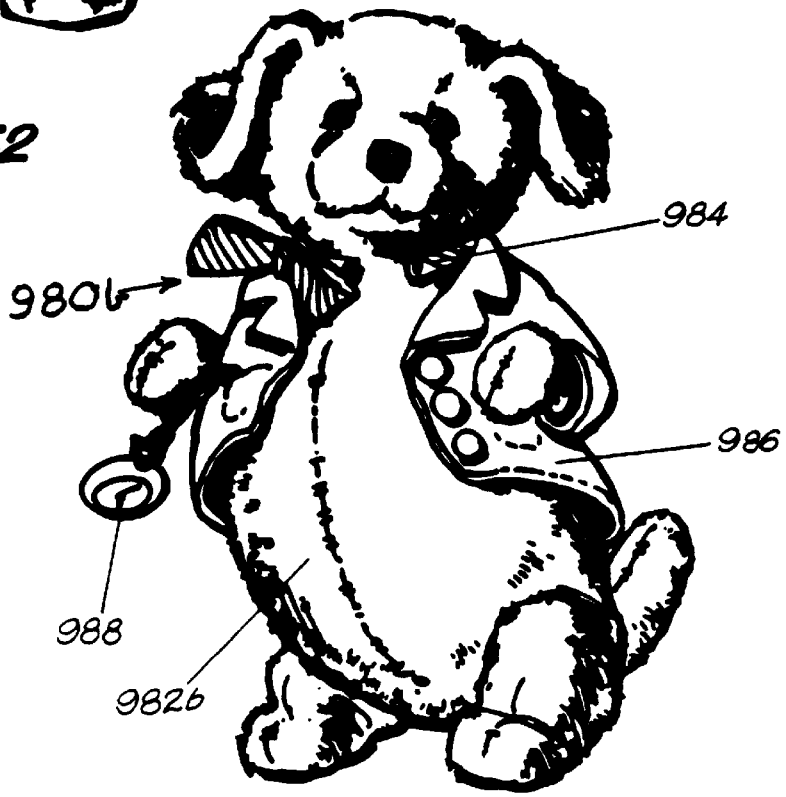

Referring now to FIGS. 52 and 53, the weight gain or loss concept may be given a somewhat whimsical application by utilizing the inventive concept with toy animal figures. For this reason, referring to FIGS. 52 and 53, for example, there are shown lighter and heavier versions of the same toy animal 980*a*, 980*b*. In FIG. 52, the animal 980*a* is thinner than the animal 980*b* shown in FIG. 53. The animals are similar except that an expansible stomach or mid-section area 982*a* is provided which, upon inflation, may assume the contours shown at 982*b* in FIG. 53. Any one of the constructions described for providing inflatable bladder may be used for this purpose.

FIG. 52 illustrates how clothing, such as a snap-on bow tie 984, a jacket 986 and a watch and chain 988 may be used to dramatize weight gain. FIG. 53 shows the toy dog 980*b* with the enlarged mid-section 982 having dislodged the watch 988, and having popped open the vest or jacket 986 and the bow tie 984. Such apparent "weight gain" would signal to a user that a healthier diet or other form of weight reduction is in order, and the user might simulate the application of a better dietary regimen on the animal in order to simulate "weight loss". For this purpose, bleed air valves of a suitable type including those described in detail, may be provided.

Referring now to materials used in the practice of the invention, the outer skin is most desirably made from a film forming material such as a latex elastomer. Such material may be formed with or without reinforcing, such as expansible fabric. Various kinds of elastic cloth can serve the purpose of permitting expansion. In this connection, a variety of materials have been described in present day or further improved materials may also be used if they are impermeable, capable of repeated elastic deformation and may be made air tight.

It will thus be seen that the present invention provides a toy, doll, or mannequin with dimensionally variable exterior surface and methods of making the same, said products and method having a number of novel advantages and characteristics, including those referred to specifically herein and others which are inherent in the invention. Various forms of the invention having been described in detail, by way of example, it is anticipated that the variations in the described form of construction may occur to those skilled in the art, and that such variations may be made without departing from the spirit of the invention or the scope of the appended claims.

I claim:

1. A method of manufacturing a doll, toy, or mannequin product having a relatively rigid core portion with at least an interior passage terminating in an opening and an exterior surface, said exterior surface being in the shape of at least one body part, said exterior surface having a given size and being covered by an elastic skin with portions movable between an initial position closely overlying said core portion and a second position wherein said movable portions of said elastic skin assume a size larger than said given size and a different shape than said exterior surface shape of said core, said method comprising dividing said exterior surface of said core into first and second areas that are to be respectively adherent and non-adherent to said skin-forming material when said material is cured, thereafter covering both said first and second areas of said core portion with a continuous coating of a curable, elastic skin-forming material, curing said coating to form a fluid-impermeable elastic skin overlying said exterior surface of said core portion, said skin becoming thereby adherent to said core in said first area of said core, those portions of said cured elastic skin overlying said second areas of said core portion being non-adherent to said core, said skin being thereby expansible away from said core portion in said second area and defining, in combination with portions of said core exterior surface, an expansible space that may be filled with a pressurizable fluid passing through said core to inflate said skin from said given size to said larger size and said different shape to create a visible change in the exterior appearance of said body part of said toy, doll, or mannequin.

2. A method as defined in claim 1 wherein said second area of said core portion is additionally treated with a release agent to ensure that said core portion remains free of adhesion to said skin-forming material.

3. A method as defined in claim 1 wherein said curable, elastic skin-forming material is a rubber latex material.

4. A method as defined in claim 1 wherein covering said core with said coating of said curable, elastic skin-forming material comprises dipping said core into a container of said curable material, and, before curing said material, removing said core while said skin-forming material is in the form of a continuous film covering both said first and said second areas.

5. A method as defined in claim 1 wherein covering said core portion with said curable skin-forming material comprises spraying a film of said skin-forming material over selected surfaces of said core portion.

6. A method as defined in claim 1 wherein said core portion comprises the torso of a toy or doll simulating a human figure.

7. A method as defined in claim 1 wherein said at least one body part comprises the torso, head and face of a doll, toy, or mannequin.

8. A method as defined in claim 1 wherein said at least one body part comprises a replica of the body of a human and includes a torso, and arm and leg portions.

9. A method as defined in claim 1 wherein said core portion includes a substantially hollow interior and at least one opening in an outer surface of said core portion facing said skin, said opening communicating with said substantially hollow interior, whereby a pressurizable fluid may move from said hollow interior through said opening and into said expansible space.

10. A method as defined in claim 1 wherein said core comprises the torso of a simulated human person, said adherent areas include a neck portion, a shoulder portion and a waist portion of said torso.

11. A method as defined in claim 10, wherein said core comprises a torso and a pair of arms, and wherein said adherent areas include a pair of cuff portions on said arms.

12. A method as defined in claim 10, which further includes non-adherent areas defining the abdominal muscles and the chest muscles.

13. A method as defined in claim 10, which further includes non-adherent areas defining the abdominal muscles, the chest muscles and the back muscles.

14. A method as defined in claim 11, wherein said non-adherent areas include areas defining the bicep portions of both arms.

15. A method as defined in claim 3, wherein said curable elastic skin-forming material is a slightly reinforced rubber latex material.

16. A method as defined in claim 17, wherein said change of size and shape simulates muscle growth.

17. A method of creating a doll, toy, or mannequin having a relatively rigid core portion and at least an interior passage terminating in an opening and with outer surfaces in the form of at least one body part of a given size and shape, said body part outer surfaces being covered by a continuous elastic outer skin closely overlying said surfaces so as to have a size and shape very similar to said surfaces, and with said skin having selected portions thereof secured to said outer body part surfaces in fluid-tight relation and the remainder non-adhesively overlying said surfaces so as to permit formation of an expansible space between portions of said body part outer surfaces and portions of said skin, said method comprising providing a replica of said core portion with an exterior surface that is non-adherent to a given skin-forming material, coating said exterior surfaces of said replica with said given skin-forming material, curing said material into a continuous elastic skin having a size and shape simulating said exterior surface of said replica, removing said cured elastic skin thus formed from said replica, positioning said cured elastic skin over the core of a toy, doll, or mannequin core, and bonding only selected areas of said skin to said core, and leaving the remainder of said skin overlying but not bonded to said core to provide a fluid-impermeable, expansible skin covering the non-selected areas of said core, whereby supplying a pressurized fluid to said expansible space will cause said skin covering said core of said toy, doll, or mannequin to visibly change its size and shape.

18. A method as defined in claim 17 wherein said change of size and shape simulates weight change.

19. A method as defined in claim 17 wherein coating said exterior surface of said replica comprises dipping said replica into a supply of liquid skin-forming material.

20. A method as defined in claim 17 wherein coating said exterior surfaces of said replica comprises spraying a liquid skin-forming material over the outer surface of said replica.

* * * * *